US006167850B1

(12) United States Patent
Blount

(10) Patent No.: US 6,167,850 B1
(45) Date of Patent: Jan. 2, 2001

(54) ROTARY COMBUSTION ENGINE WITH PISTONS

(76) Inventor: David H. Blount, 6728 Del Cerro Blvd., San Diego, CA (US) 92120

( * ) Notice: Under 35 U.S.C. 154(b), the term of this patent shall be extended for 0 days.

(21) Appl. No.: 09/236,744

(22) Filed: Jan. 25, 1999

(51) Int. Cl.[7] ..... F02B 57/00; F02B 57/06
(52) U.S. Cl. ..... 123/44 D; 123/44 E
(58) Field of Search ..... 123/44 D, 44 E

(56) References Cited

U.S. PATENT DOCUMENTS 1,157,811 * 10/1915 Shannon ..... 123/44 D
1,184,651 * 5/1916 Johnston ..... 123/44 D
1,394,587 * 10/1921 Stewart ..... 123/44 E
2,242,231 * 5/1941 Cantoni ..... 123/44 D
3,292,603 * 12/1966 Wayto ..... 123/44 D
4,038,949 * 8/1977 Farris ..... 123/44 D

FOREIGN PATENT DOCUMENTS

19666 * 8/1911 (GB) ..... 123/44 D
6-207501 * 7/1994 (JP) ..... 123/44 D

* cited by examiner

*Primary Examiner*—Michael Koczo

(57) ABSTRACT

This invention relates to an apparatus for producing a rotary motion force by means of an internal combustion engine, rotary type with pistons in the circular rotor, consisting of a housing, a rotor with cylinder chambers containing pistons that is connected to a shaft, and combined with a rotor, piston and rod guiding system, fuel system and ignition system. This engine may be produced in any suitable size and may also be powered by an expanding heated liquid or gas. The engine has many uses such as to power machinery, automobiles, motorcycles, boats, etc.

18 Claims, 18 Drawing Sheets

ROTARY COMBUSTION ENGINE WITH PISTONS

BACKGROUND OF THE INVENTION

This invention relates to an apparatus for producing a rotary motion force by means of an internal combustion engine of the rotary type with pistons, provided with a rotor which has a circular shape and contains pistons which reciprocate in the rotor. The rotor is rotationally mounted on a centrally located engine shaft in a fixed housing having a cavity formed by a circular peripheral inner wall and two side walls. The pistons are reciprocally mounted in a cylinder in the rotor and reciprocation of the pistons is guided by a fixed piston guide plate, and the rotor is rotated by the piston rod putting pressure on the piston guide plate.

Many rotary combustion engine have been invented in the past such as the James Watt rotary steam engine, Gilbert's engine, Cooley's engine, Selwood engine, Wankel's engine, Walter's engine, Farwell's engine, Mercer engine, Porsche rotary engines, Virmel engine, Kauertz engine, Geiger engine, Franke engine, Blount's engines and others, but all of these are different than the engine of this invention.

The improved engine of this invention is of the novel rotary type engine with the pistons reciprocating in the rotor as the rotor rotates, and the pistons' reciprocal motions are guided by a stationary piston guide and a rotatable rod guide. The rotatable rod guide keeps the pistons in the right position, and the stationary piston guide reciprocates the pistons up and down as the rotor rotates. The engine of this invention is entirely different from the known types of rotary engines.

The present novel rotary apparatus with reciprocating pistons of this invention may be utilized as an internal combustion engine, as a combination of an internal combustion engine and a compressor and/or pump, as a steam engine, as a pump, as a gas compressor and as an engine powdered by expanding heated liquid or gases.

The basic rotary internal combustion engine with reciprocal pistons of this invention consists of stationary cylindrical housing with cylindrical inner walls, front and back side walls, circular rotor rotationally mounted in the housing on a centrally located round shaft and rotates with the shaft, a rotor contains circular cylinder chambers for the reciprocating pistons which are reciprocally guided by a stationary piston guide plate and a rotating rod guide rod plate attached to the shaft, an ignition system, a gas mixture intake port and an exhaust port. The rotor has a centrally located chamber to house the stationary piston guide plate and rotating rod guide plate and compression chamber and/or oil chamber. The rotor contains combustion chambers (cylinder chambers) above the pistons which are sealed off by means of seals on the rotor and rings on the pistons. The rotor is attached to the shaft and rotates with the centrally located shaft. The round shaft extends through the center of the side walls. The cylinder chambers volumes vary in size when the rotor rotates and the pistons reciprocate, thereby the strokes of suction, compression, ignition and exhaustion takes place in the cylinder chambers.

The apparatus of this invention is relatively simple in construction and operation whereby the engine can be produced at relatively low cost. Fewer parts are required in its construction when compared with conventional reciprocal engines. This new engine design should improve the efficiency of the engine operation and is extremely desirable. Each cylinder chamber may be fired one or more times per rotation.

SUMMARY OF THE INVENTION

The object of the present invention is to produce an improved internal combustion engine which is of the rotary type with reciprocal pistons in the rotor. Another object is to provide a novel apparatus which is a rotary combustion engine with reciprocal pistons in the rotor which also has a chamber for compressing a gas. Another object is to produce an apparatus which may be utilized as a two cycle rotary internal combustion engine or as a four cycle rotary internal combustion engine. Another object is to produce and apparatus which has the strokes of suction, compression, ignition and exhaustion. Still another object is to produce multiple arrangement of the rotary internal combustion engine of this invention. Another object is to produce an apparatus which may be utilized as a compressor and as an engine powered by the expansion of heated gases or liquids.

The two cycle and four cycle rotary internal combustion engine of this invention consist of:

1. Housing, a stationary hollow cylindrical housing having a cylindrical inner peripheral wall which forms a circular cavity with room for a rotor to rotate, and has a front side wall (head) and a rear side wall. The housing has passage ways for admitting a gaseous mixture to the cylinder chamber and passage ways for discharging combustion gases from the cylinder chamber. There are one or more spark plug ports in the housing which open into the cylinder chambers, and may have fuel injection ports in the housing which open into the cylinder chambers.
2. Rotor, a rotatable cylindrical rotor with a centrally located compression and/or oil chamber and one or more cylinder chambers extending from the rotor's peripheral wall down to the centrally located compression and/or oil chamber, front and posterior wall with means for the posterior wall of the rotor to attach to the shaft, and an opening in the center of the anterior wall of the rotor for the shaft and piston guide holder to pass through. The rotor has compression and oil seals to seal the combustion chamber and compression and/or oil chamber from each other.
3. Piston, a cylindrical piston which reciprocates in the cylinder chamber of the rotor, and has rings on the peripheral surface to seal the combustion chamber from the centrally located compression and/or oil chamber. The piston has a piston rod located centrally on the bottom of the piston, and has means to guide the reciprocal motions of the piston and to apply a force on the piston guide plate thereby forcing the rotor to rotate.
4. Engine shaft, consisting of a round shaft which passes through the center of the housing walls and extends out the center of the front and posterior walls, and has means for the rotor to be attached to the shaft.
5. Piston guide plate, consisting of a solid stationary plate with peripheral wall having various shapes suitable to guide the reciprocal motions of the piston. The piston guide plate has means to be attached to the front wall of the housing and means for the piston rod bearing to rotate on the peripheral area of the piston guide plate and the rod inner guide pin to rotate under the piston guide plate.
6. Piston rod guide, consisting of solid plate with slots for the piston rod or rods to reciprocate through and keep the pistons parallel to the cylinder wall, and has means for being attached to the shaft and/or posterior rotor wall or is located in the bottom of the cylinder and rotates with the rotor.

7. Ignition system, consisting of means for ignition of compressed gaseous mixture for expansion of cylinder chambers due to the pressure on the piston from the combustion products.
8. Fuel system, consisting of means for supplying fuel and air to the combustion chambers.

The basic engine components of the engine of this invention may be used in a two cycle or a four cycle engine or in a multiple two cycle or four cycle engine. The two cycle engine's intake and exhaust ports are located in a position where the expanded combustion gases escape when the cylinder chamber has expanded to it's maximum volume, whereas in a four cycle engine the intake and exhaust ports are located in the area where the cylinder chamber is smallest so the fuel-air mixture can be drawn in when the cylinder chamber expands, and the expanded combustion gases can be pushed out as the cylinder chamber becomes smaller. In a rotary two cycle engine with two or more pistons the strokes of compression, ignition and exhaustion take place at the same time in each cylinder chamber. In a four cycle rotary engine with two pistons the strokes suction, compression, ignition and exhaustion take place at different times. The strokes of ignition and expansion take place in one cylinder chamber and the stroke of suction takes place in the other cylinder chamber. The timing of these strokes may be varied by changing the shape of the piston guide plate.

The compression ratio and the reciprocal motions are controlled by the design of the piston reciprocal guide plate. The compression ratio and the reciprocal stroke may be designed as desired. In a two cycle rotary engine the fuel-air mixture is vacuumed into the central compression chamber by the reciprocal motion of the pistons toward the housing (compression stroke) and compressed by the reciprocal motion (expansion stroke) of the pistons toward the central chamber or the air may be drawn in by the reciprocal motion of the pistons toward the housing and the fuel is injected directly into the cylinder chamber.

The fuel systems for this rotary internal combustion engine of this invention may be selected from a fuel pump-carburetor system, direct injection system or an air-assisted fuel system or any other desirable means. In a two cycle rotary internal combustion engine with pistons the gaseous mixture may enter into a central compression chamber which communicates with the cylinder chamber or only compressed air enters into the cylinder chambers from the compression chamber, and the fuel is directly injected or air-assisted injected into the cylinder chambers utilizing compressed air from the compression chamber. In a four cycle rotary internal combustion engine of this invention the gaseous mixture may be aspirated from a carburetor into the cylinder chambers or the air may be aspirated in and the fuel directly injected or air-assisted injected into the cylinder chamber utilizing compressed air from the central compression chamber. Any suitable fuel may be utilized in the engines of this invention. Suitable fuels include but are not limited to organic gases, liquid and powders such as petroleum fuel, e.g. gasoline, other petroleum distillates, organic gases, e.g., methanol, ethanol propanol, etc, hydrogen, coal powder mixed either flammable gases or liquids. Gasoline is the preferred fuel.

The ignition system for this rotary internal combustion engine may consist of any suitable method to ignite the fuel in the combustion cylinder chambers by means of an electrical spark or heat. The preferred ignition system is the system commonly utilized in automobiles consisting of a storage battery, generator or alternator, and a timing device such as a distributor or an electronic timing device which are connected by wires to the spark plugs. The engine may have a counter balance weight attached to the shaft.

The cooling system of this rotary internal combustion engine may be cooled by means of a liquid cooling system, by an air cooling system or by a combination of these two systems. In the liquid cooling system the coolant is pumped into chambers around the walls of the housing then to a radiator for cooling then back to the engine. Cooling fins may be made into the walls of the housing and cooled by air. In two cycle rotary engine air is also utilized in the compression to assist in cooling the engine. In a four cycle rotary engine the oil in the central chamber may be circulated through an oil cooler to assist in cooling the engine.

DESCRIPTION OF THE DRAWINGS

Other object of the invention will become apparent upon reading the annexed detail description in connection with the drawing in which.

DESCRIPTION OF PREFERRED EMBODIMENT

Figure 1:
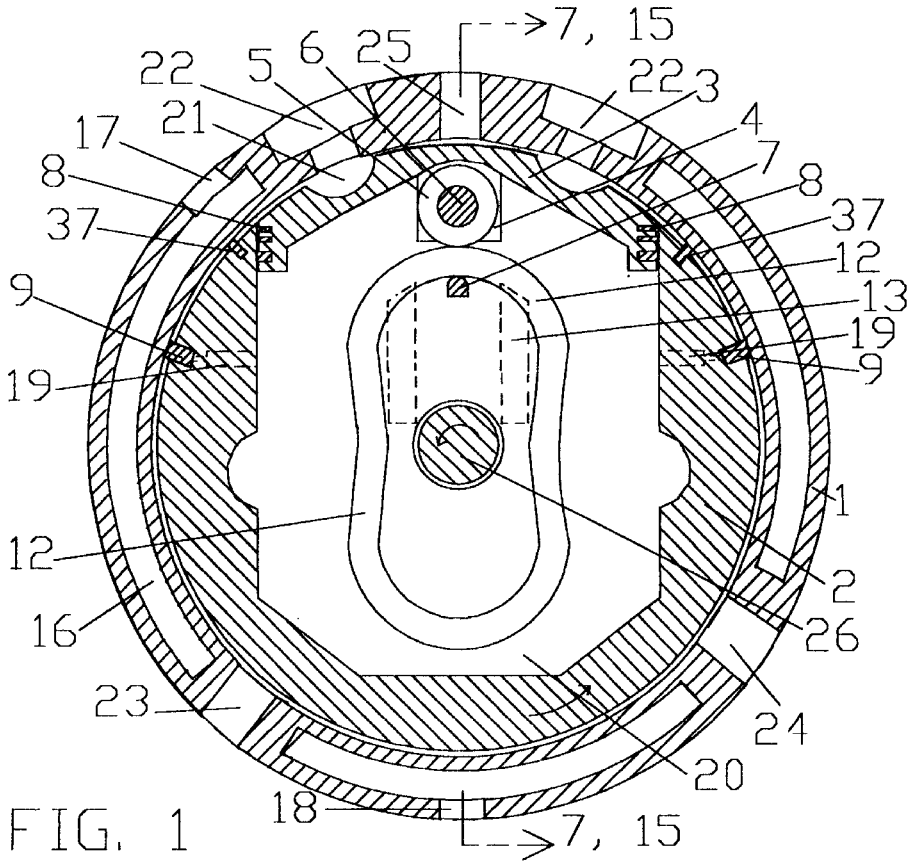
FIG. 1 is a cross sectional view of a four cycle, one cylinder chamber, rotary engine taken substantially along line 1—1 of FIG. 7.
Figure 2:
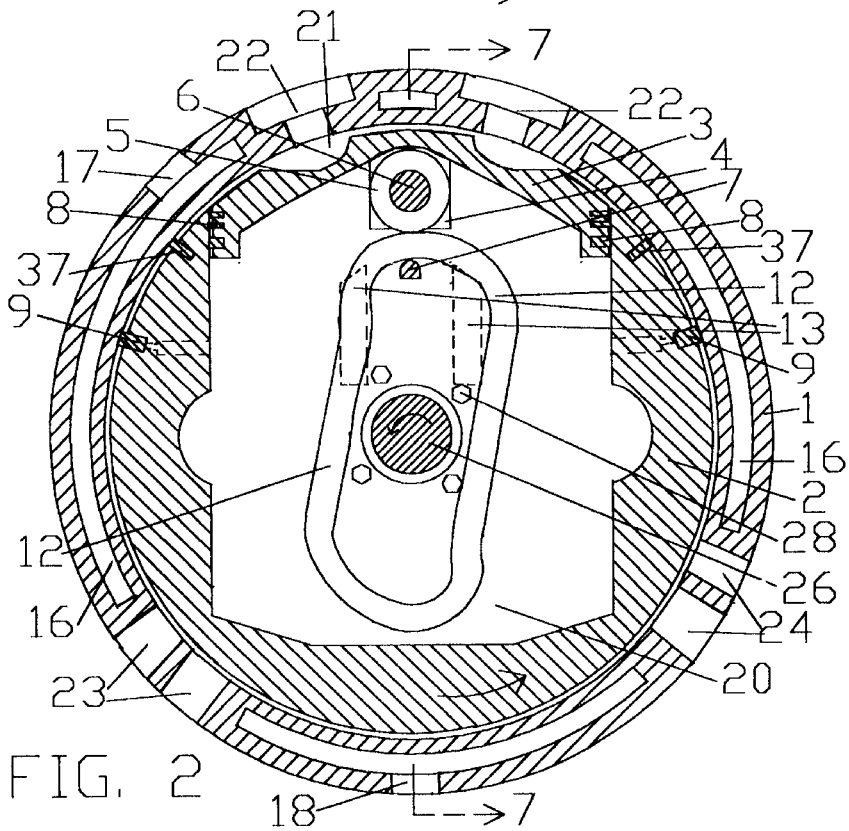
FIG. 2 is a cross sectional view of a four cycle, one cylinder chamber, rotary engine with a reciprocal guide designed for a long timed expansion stroke and a short timed compression stroke. A sectional view taken substantially along line 2—2 of FIG. 8.

Referring to the drawings and in particular to FIG. 1, the rotary engine with reciprocal piston of the present invention includes a circular engine housing 1 which has a front side wall 14 and a rear side wall 15 attached to the housing by bolts 27. The round engine shaft 26 extends out through the center of the front and rear side walls 14,15 and has a groove for pins 35. The engine housing 1 of the four cycle has an exhaust port 23, a fuel injection port 25, intake port 24, spark plug ports 22, coolant inlet 18 and outlet 17 and the housing contains coolant passage ways 16. The stationary circular housing 1 contains a circular rotor 2 which rotates with the shaft 26 and it has a circular cylinder chamber 21, seals 37 and oil seals 9. Within the rotor's 2 cylinder chamber 21 is a circular piston 3 which reciprocates in the cylinder chamber 21 and rotates with the rotor 2. The peripheral area of the piston 3 has rings 8 to seal off the combustion chamber 21 from the oil in the central chamber 20. The piston 3 has a piston rod 4 which fits into a rotating rod guide groove 13 which keeps the rod 4 and piston 3 straight. The rod 4 has an inner guide pin 7 and bearing 6 which is held in place by a pin 6. The rod bearing travels over a stationary oval shape piston guide 12 and the inner rod guide 7 fits under the piston guide 12 thereby guiding the reciprocal motion of the piston 3. The piston guide plate 12 is bolted to the front wall 14. The rod guide plate 13 is bolted to the engine shaft 26 and/or posterior wall of the rotor 2 or to the cylinder's side. Referring to FIG. 2 the rotary four cycle engine is similar to FIG. 1 but does not have a fuel injection system, and the piston guide plate 12 is designed for the engine to have a longer timed expansion and suction stroke and a shorter timed exhaust and compression stroke. The fuel and air mixture enters the engine by way of an intake port 24 in the housing 1.

Figure 3:
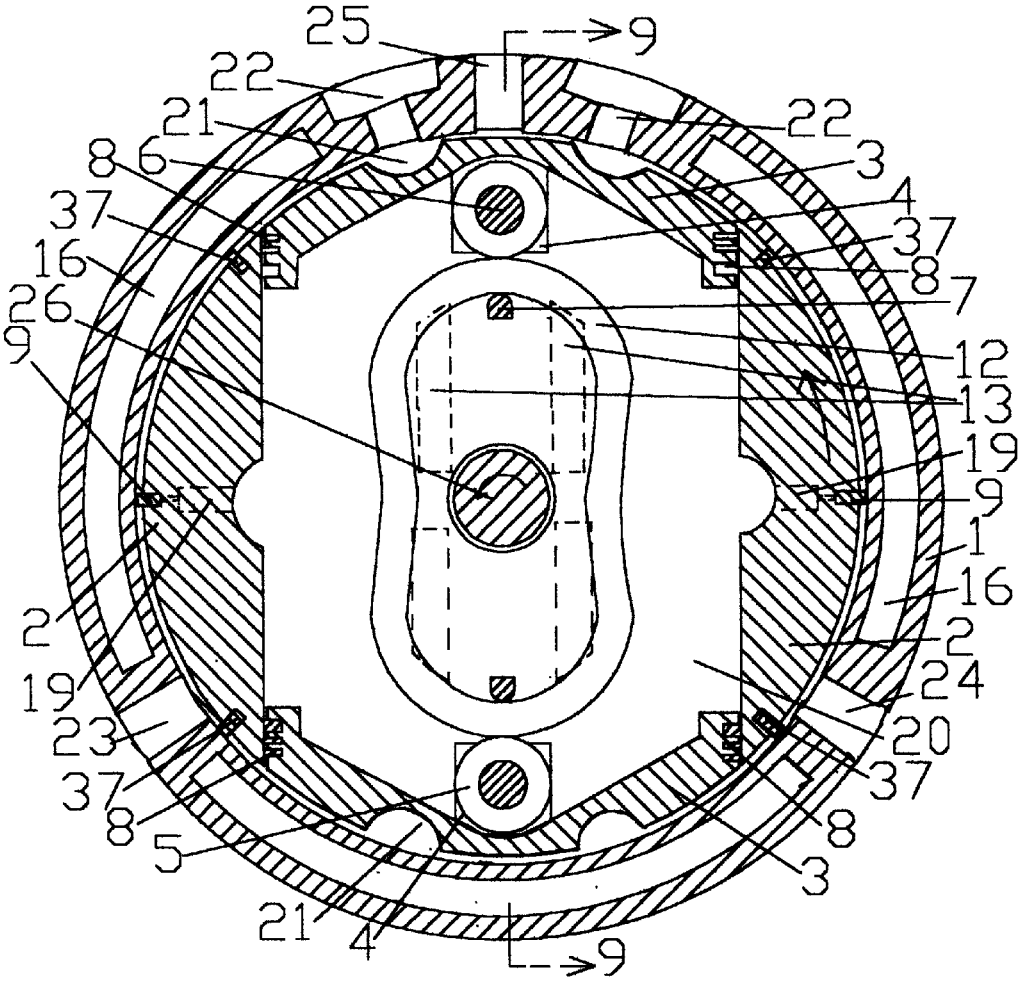
FIG. 3 is a cross sectional view of a four cycle, two cylinder chambers, fuel injected, rotary engine. A sectional view taken substantially along line 3—3 of FIG. 9.
Figure 4:
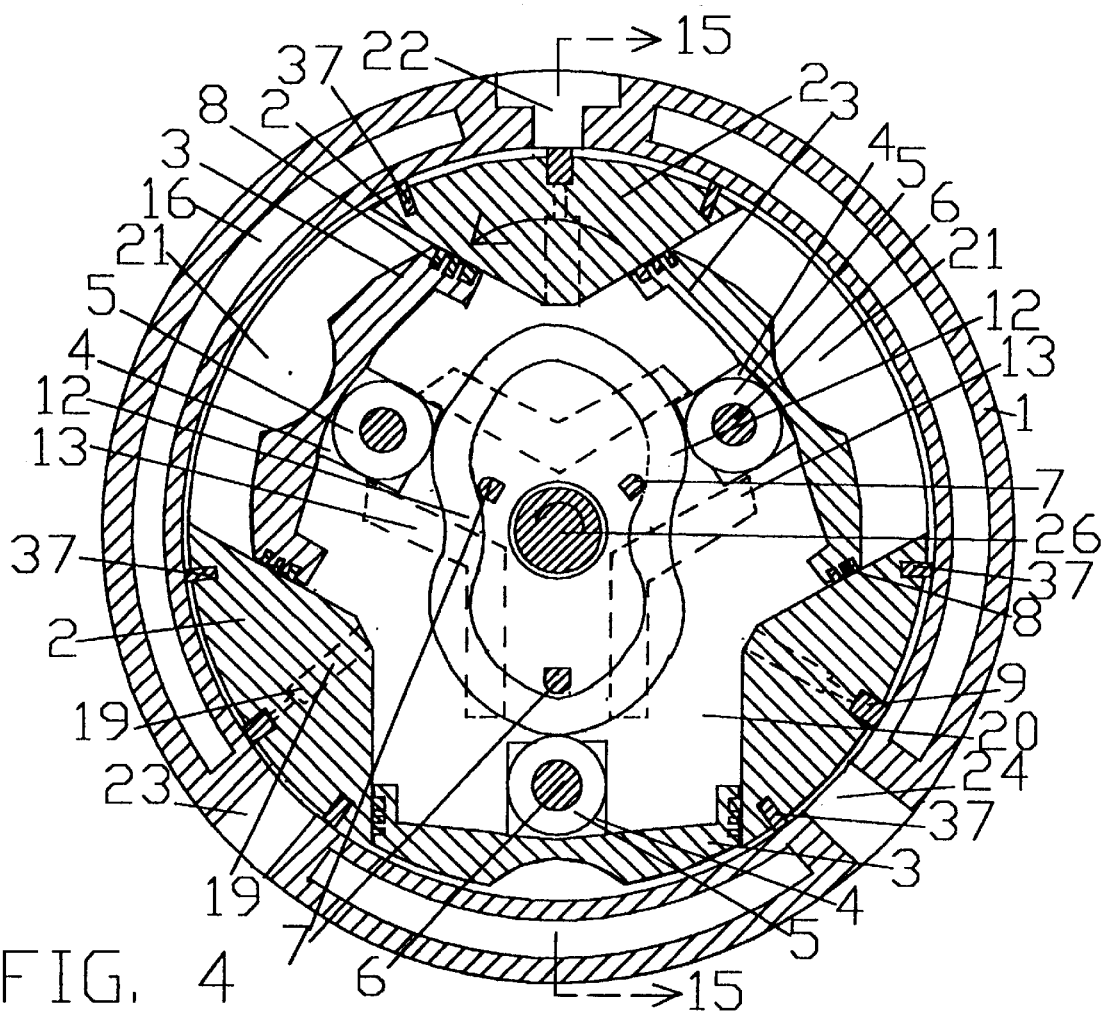
FIG. 4 is a cross sectional view of a four cycle, three cylinder chambers, rotary engine.
Figure 5:
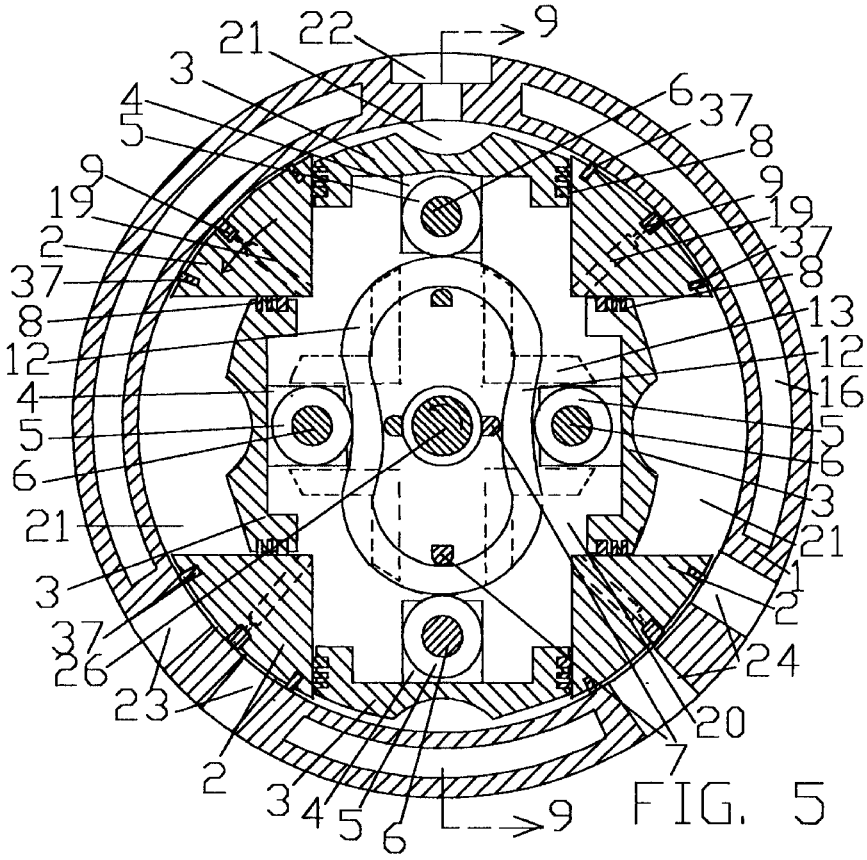
FIG. 5 is a cross sectional view of a four cycle, four cylinder chambers, rotary engine.
Figure 6:
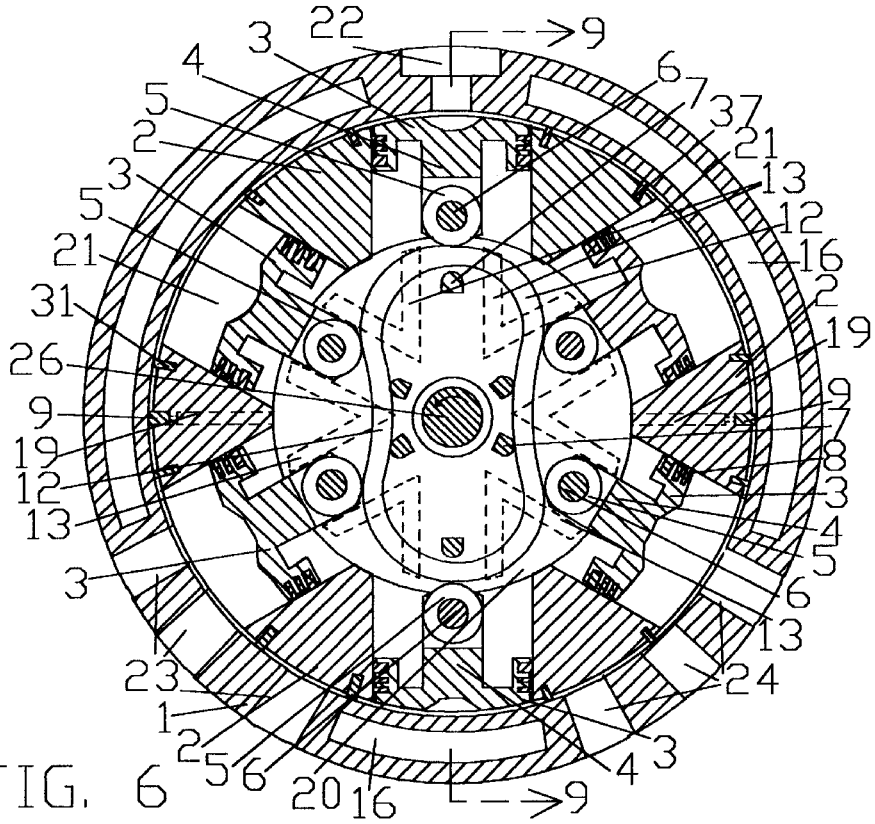
FIG. 6 is a cross sectional view of a four cycle, six cylinder chambers, rotary engine taken substantially along line 6—6 of FIG. 9.

Referring to FIG. 3, FIG. 4, FIG. 5 and FIG. 6 which are four cycle rotary engines with different numbers of pistons 3 and they are similar to FIG. 1. FIG. 3 is a four cycle rotary engine with two cylinder chambers 21 and the stationary engine housing 1 has a fuel injection port 25, two spark plug ports 22, an exhaust port 23 and an intake port 24. The rotatable rotor 3 has two cylinder chambers 21 opposite each other and has two pistons 3 which has rings 8 to seal off the combustion chambers from oil in the center chamber 20. The reciprocal motion of the pistons 3 in the cylinder chambers 21 are guided by a rotating rod guide plate 13 and by a stationary piston guide plate 12. The piston guide plate 12 is bolted to the front engine wall 14 and the rod guide plate 13 is bolted to the engine shaft 26 and/or rear wall of the rotor 2. FIG. 4 is a four cycle rotary engine with three cylinder chambers 21, three pistons 3, one spark plug port 22 and has a fuel-air intake port 24 otherwise is similar to FIG. 3. FIG. 5 is a four cycle rotary engine with four cylinder chambers 21, four pistons 3, a spark plug port 22, exhaust ports 23 and intake port 24 other wise similar to FIG. 3. Each piston 3 has rings 8 to seal the combustion chamber 21 from the oil in the central chamber 20. The pistons 3 reciprocal motion is guided by a stationary piston guide plate 12 and a rotatable rod guide plate 13 which is attached to the engine shaft 26. FIG. 6 is a four cycle rotary engine with six cylinder chambers 21 and six pistons 3, a spark plug port and is similar to FIG. 5 in structure.

Figure 7:
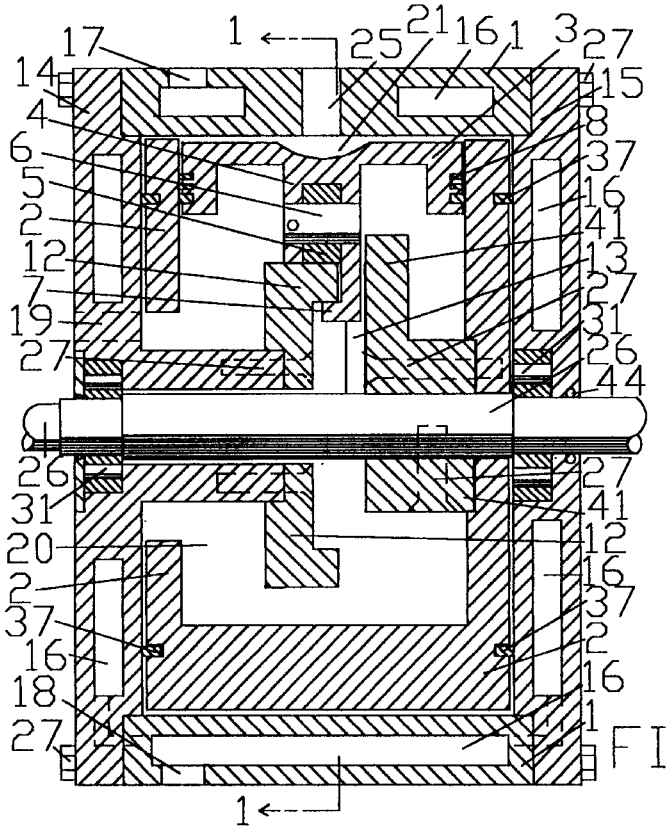
FIG. 7 is a sectional view of a four cycle, one cylinder chamber, fuel injected, rotary engine taken substantially along line 7—7 of FIG. 2.
Figure 8:
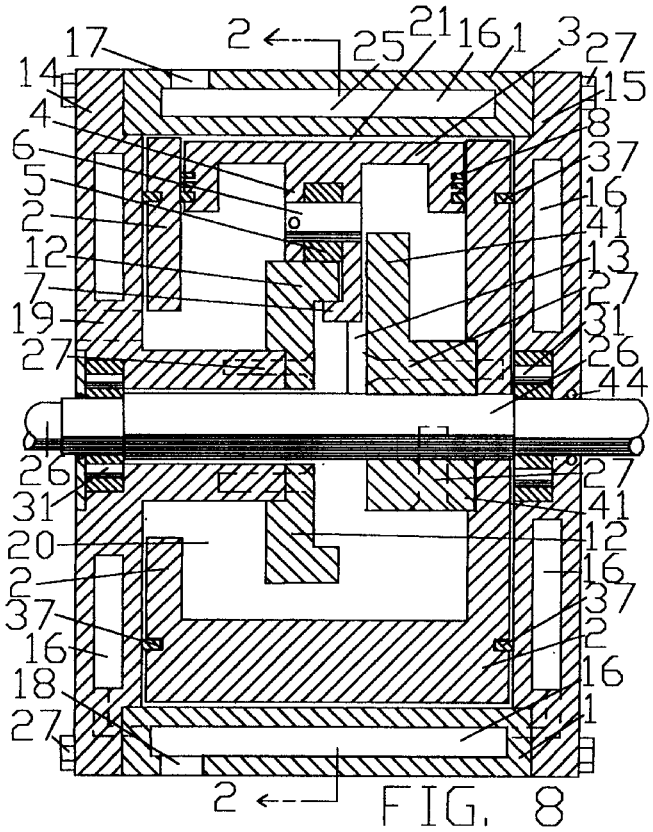
FIG. 8 is a sectional view of a four cycle, one cylinder chamber, rotary engine.
Figure 9:
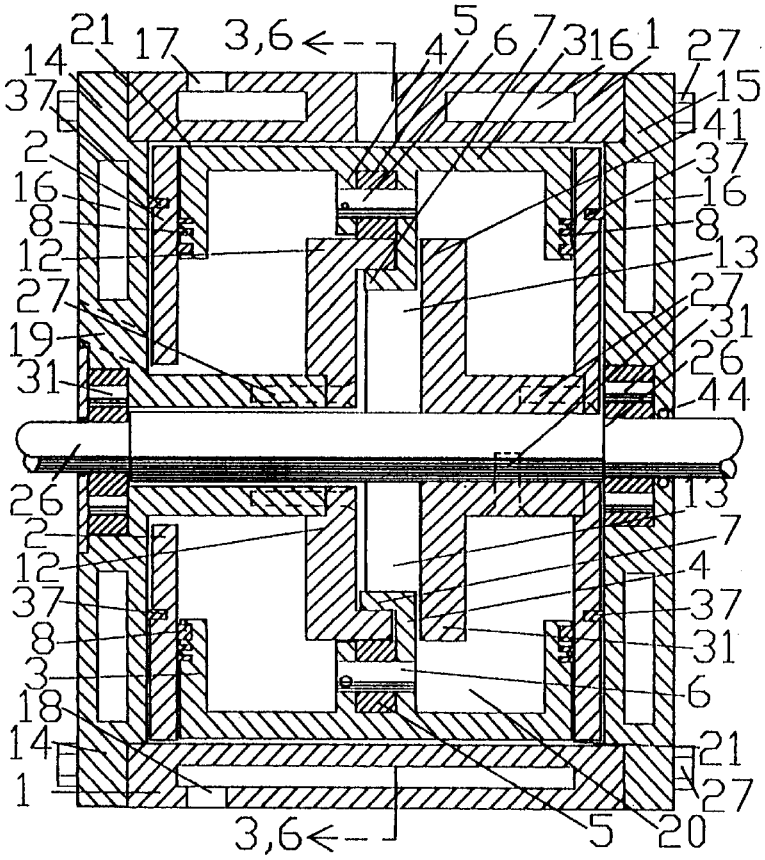
FIG. 9 is a sectional view of a four cycle, two cylinder chambers, rotary engine taken substantially along line 9—9 of FIG. 3.

Referring to FIG. 7, FIG. 8 and FIG. 9, which are sectional views of the rotary engine of this invention, and FIG. 7 is a four cycle, 1 cylinder rotary combustion engine similar to FIG. 1 but without fuel injection. FIG. 8 is a four cycle, 1 cylinder rotary combustion engine similar to FIG. 1 but does not have fuel injection and has two spark plug port 22. FIG. 9 is a four cycle rotary combustion engine similar to FIG. 3 and the rotor 3 has two cylinder chambers 21, two pistons 3 with rings 8 and a piston rod 4 on each piston 3 with means to rotate around the stationary piston guide plate 12. The rings 8 seals off the cylinder's combustion chamber 21 from the central oil chamber 20. The reciprocal motion of the pistons 3 is guided by the rotating rod guide plate 13 which is bolted to the posterior wall of the rotor 3 and/or shaft 26. The shaft 26 has bearings 31 and seals 44 in the center of the anterior and posterior walls 14, 15 and the shaft 26 protrudes through the center of the anterior and posterior walls 14, 15. The anterior and posterior walls have oil seals 44 that press on the shaft 26 and seal off the central oil chamber 20. The rotor 3 has seals 37 on the peripheral and side walls which seal one cylinder chamber 21 from the other and from the central chamber 20.

Figure 10:
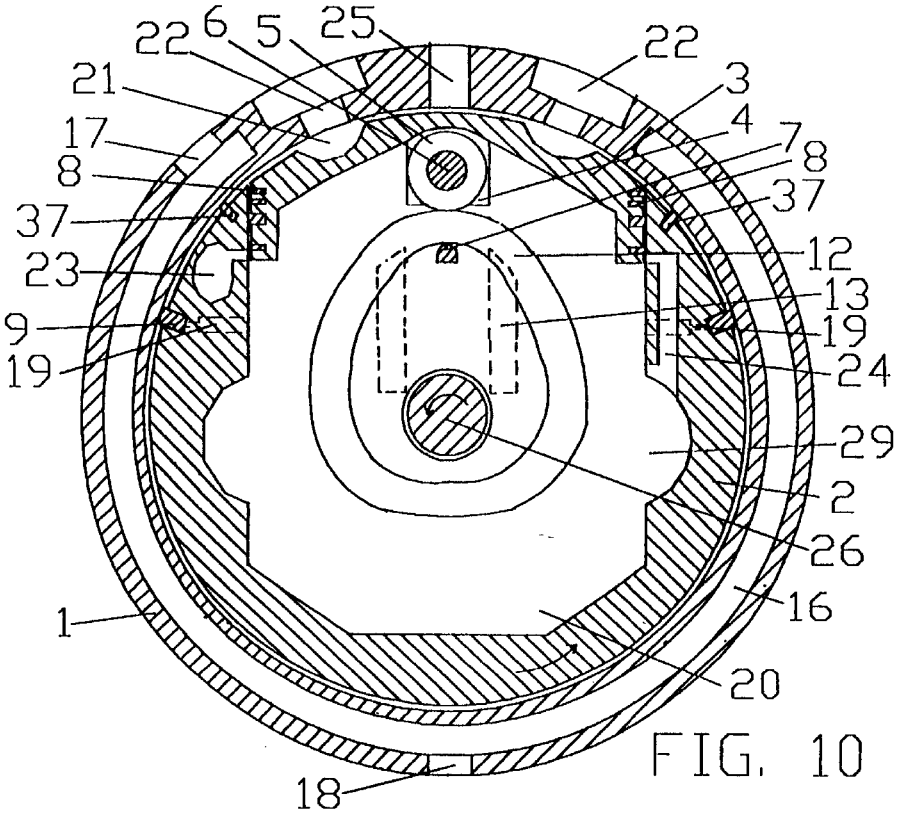
FIG. 10 is a cross sectional view of a two cycle, one cylinder chamber, fuel injected, rotary engine.
Figure 11:
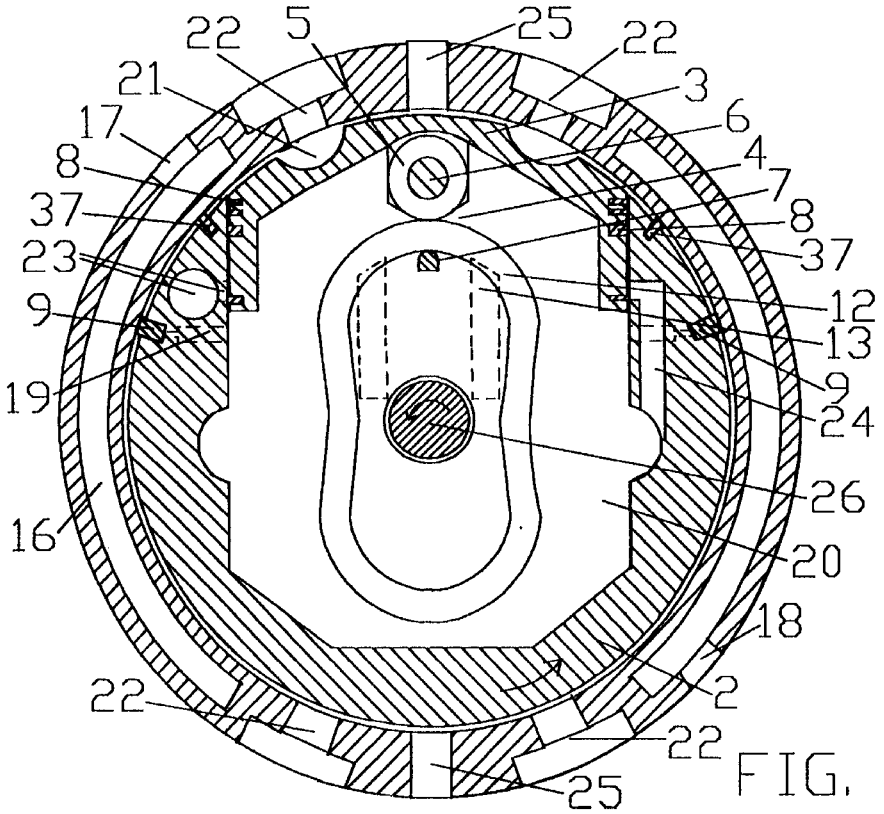
FIG. 11 is a cross sectional view of a two cycle, one cylinder chamber, fuel injected, rotary engine which fires twice per rotation.
Figure 12:
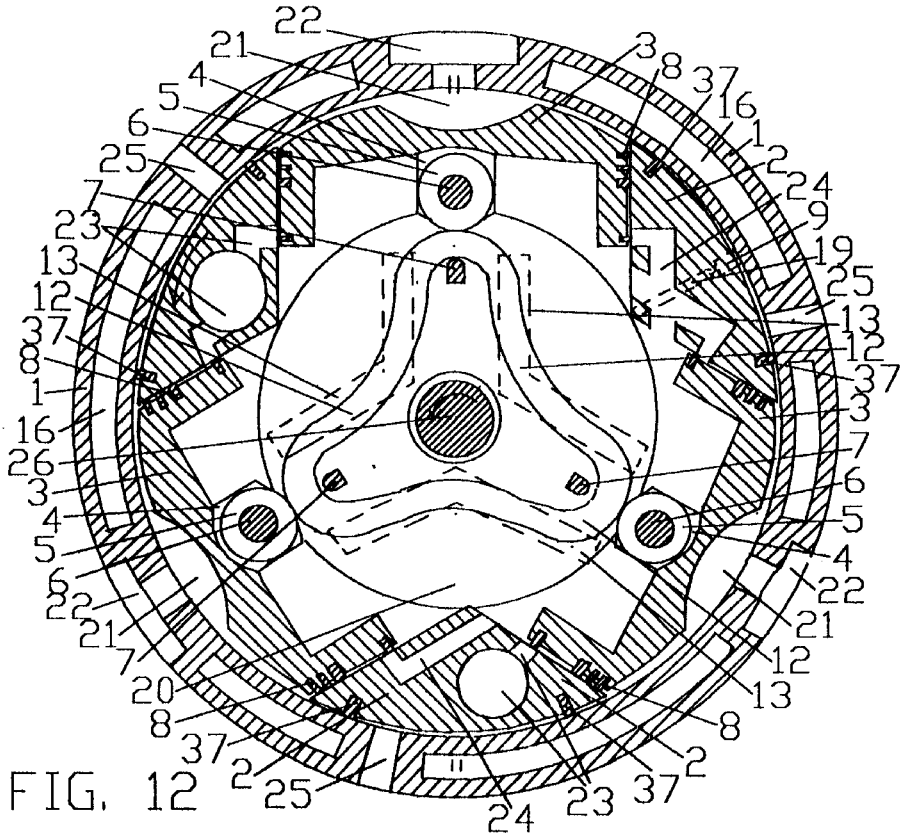
FIG. 12 is a cross sectional view of a two cycle, three cylinder chambers, rotary engine.

Referring to FIG. 10, FIG. 11 and FIG. 12 they are two cycle rotary combustion engines which are similar to FIG. 1 except that the exhaust gases flow through the piston's wall and are released out the exhaust port 23 in anterior wall 14 or posterior wall 15 of the housing 1. The intake port 24 for air, fuel-air and oil is in the anterior wall 14 of the housing 1. FIG. 10 shows a cross section view of the circular housing 1 with a circular inner wall which has two spark plug port 22, a fuel injection port 25, a coolant intake port 18, a coolant outlet port 17 and coolant passages 16. Within the housing 1 is a rotatable circular rotor 2 which has one cylinder chamber 21, a central oil and compression chamber 20, an exhaust passage 23, an intake passage 24 and seals 37, and oil rings 9 with an oil passage 19 on the peripheral of the rotor 2 which seals the cylinder's combustion chamber from the rest of the inner wall of the housing. The cylinder chamber 21 has a piston 3 which has rings 8 to seal the combustion chamber 21 from the central oil and compression chamber 20. The piston 3 has a centrally located rod 4 on the bottom of the piston 3 which has a bearing 5, which is held in place by a pin 6 and rolls on the stationary oval piston guide plate 12 and its reciprocal motions are guided by the grooves in the rotating rod guide plate 13 thereby keeping the piston straight. The piston rod 4 has a inner guide pin 7 which fits under the stationary piston guide plate 12 and pulls the piston 3 toward the central chamber on the suction stroke. FIG. 11 is a 2 cycle, 1 cylinder chamber 21, combustion rotary engine wherein the housing has two sets of fuel injection ports 25 and two sets of double spark plug ports 22 at 180 degrees a part, and coolant passages 16. Within the housing 1 there is a rotor 2 and a piston 3 similar to FIG. 11, but the stationary piston guide plate 12 is different, being oblong with round ends on the top and bottom and is attached to the front wall 14. There is a central oil and/or compression chamber 20 and a centrally located rotatable shaft 26 which passes through the center of the central chamber and is attached to the rod guide 13 plate and rotor 2. The rotor 2 contains exhaust passages 23 and intake passages 24. FIG. 12 is a cross sectional view of a two cycle, three cylinder chambers, combustion engine wherein the circular housing 1 which has three injection ports 25, three spark plug ports 22, a coolant passage and has a circular inner wall. Inside the housing 1 is a rotatable rotor 2 which has three cylinder chambers 21 with three circular pistons 3, which has rings 8 to seal the cylinder chamber 21 from the central oil and compression chamber. The rotor 2 has seals 37 and oil seals 9 to seal off the peripheral area of the rotor between each cylinder chamber 21 and the central chamber 20. The rotor 2 contains exhaust passages ways 23 and intake passages ways 24. Each piston 3 has a centrally located rod 4 on the bottom of the piston 3 with a bearing 5, which is held in place with a pin 6, and the bearing 5 travels on the stationary piston guide plate 12, which is triangular in shape with rounded points and is attached to the front wall 14. The reciprocal motion of the rods 4 are guided by a rotatable rod guide grooved plate 13 which is attached to the centrally located shaft 26 and/or posterior rotor 3 wall. The rods 4 has a rod inner guide pin 7 which fits under the piston guide plate 12 and assist in the reciprocal motion of the piston toward the central chamber on the suction stroke.

Figure 13:
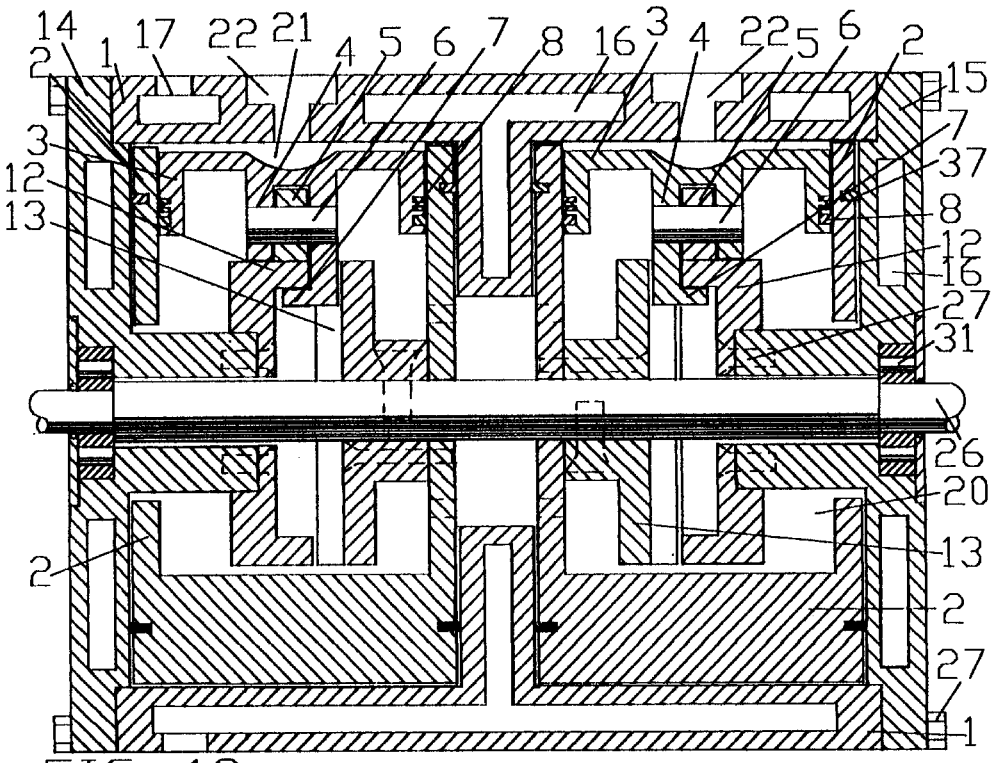
FIG. 13 is a sectional view of a four cycle, with a total of two cylinder chambers, double rotary engine.

Referring to FIG. 13 which is a section view of a four cycle, one cylinder double rotary combustion engine wherein the center walls (rear wall of each engine) are joined together. Each engine is similar to FIG. 1 except that each engine has only 1 piston port 22 and no fuel injection port. The centrally located round shaft 26 extends through both engines and out the front and rear walls 14, 15, and is attached to the pistons 3. There is a centrally located oil chamber 20 in each engine and they are open to each other. The stationary piston guide plates 12 are attached to the front and posterior wall of the double engine. The rotatable rod guide plates 13 are attached to the centrally located round shaft 26 and/or inner wall for the rotors 3. The combustion chambers 21 are sealed from each other and from the central chamber by means of the rings 8 on the pistons 3 and seal 37 on the peripheral and side walls of the rotor 3. The front and back walls 14, 15 are bolted to the stationary circular housing 1 which contains spark plugs ports 22, coolant intake port 16 and outlet port 17, coolant passage ways 16 and an inner wall between the two rotor 2 chambers. The shaft has bearings 31 on each end of the shaft and they are placed into the inside of the anterior and posterior walls.

Figure 14:
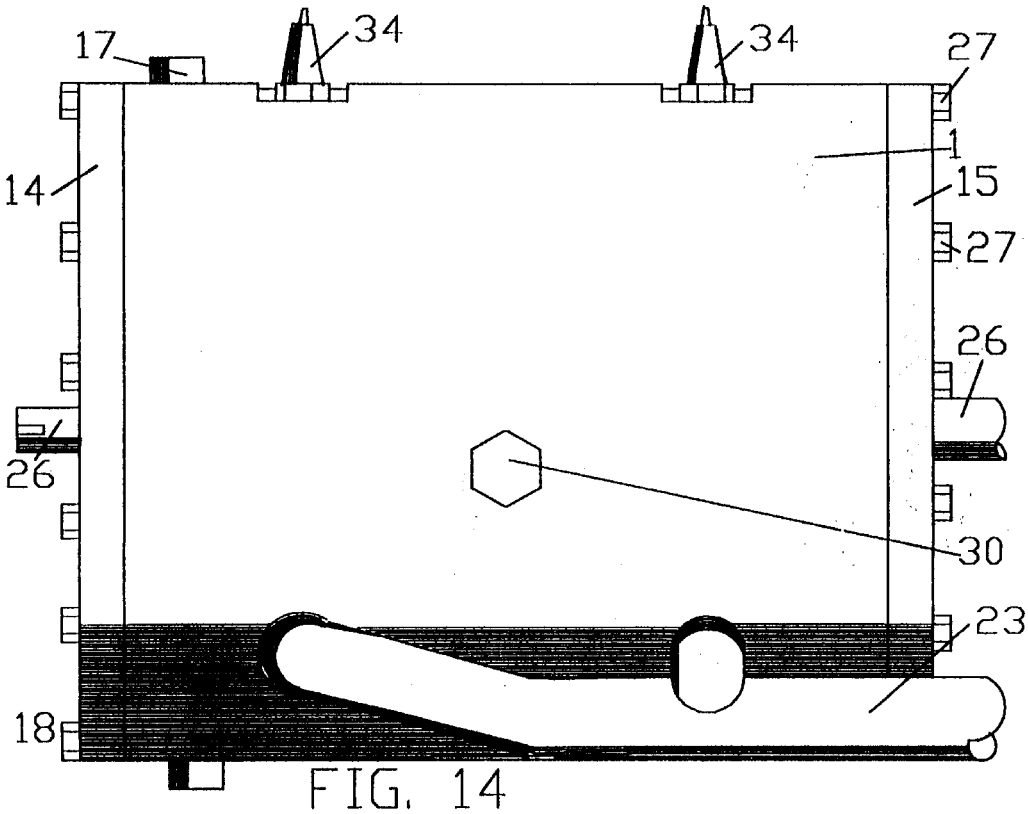
FIG. 14 is a plan view of a four cycle, with a total of two cylinder chambers, double rotary engine.
Figure 16:
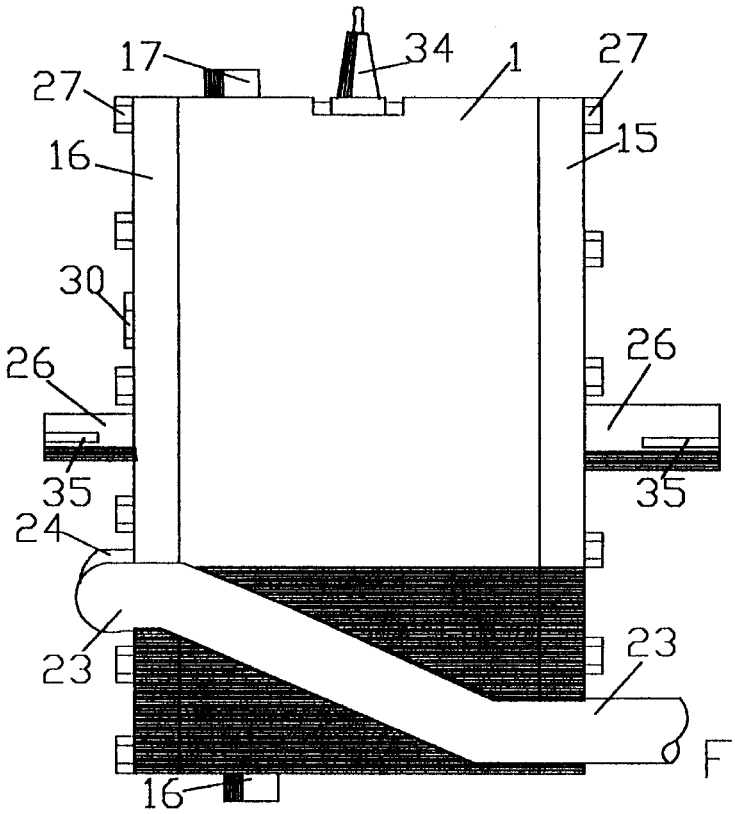
FIG. 16 is a plan view of a two cycle, one cylinder chamber, rotary engine.
Figure 15:
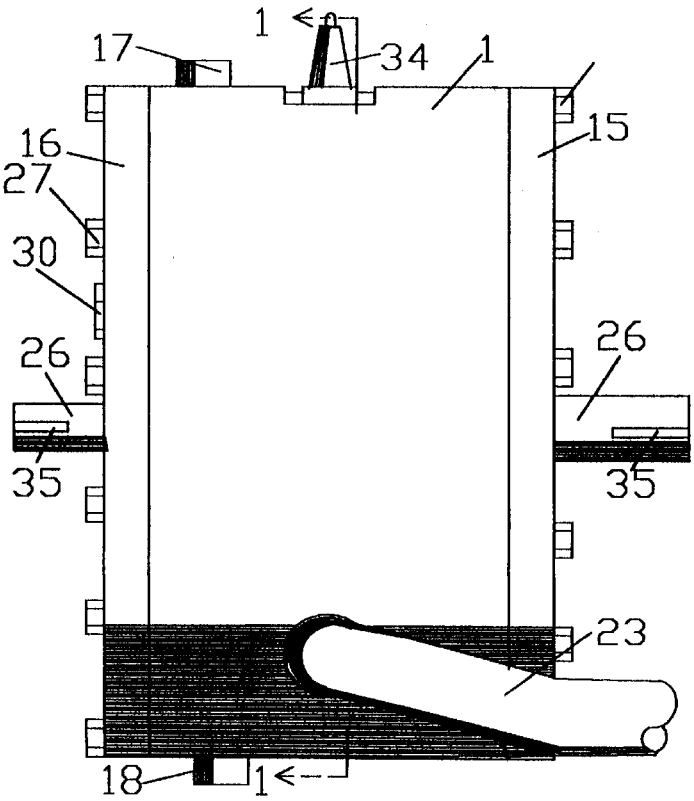
FIG. 15 is a plan view of a four cycle, one cylinder chamber, rotary engine taken substantially along line 15—15 of FIG. 4.

Referring to FIG. 14, FIG. 15 and FIG. 16 which are plan side views of the exterior of the rotary combustion engines of this invention. FIG. 14 shows the exterior of a double four cycle rotary engine which could have one or more cylinder chambers. The circular stationary housing 1 has two spark plug ports 22 with spark plugs 34, two exhaust ports 23, two intake ports 23, an oil plug 30, and coolant intake 18 and a coolant outlet 17. Bolted at 27 to the housing 1 is a front wall (head) 14 which has a round rotatable shaft, with a pin groove 35, protruding from the center of the wall. A rear wall 15 is bolted at 27 to the housing 1 and has the shaft 26 protruding from the center of the wall 15. FIG. 15 is a four cycle, one or more cylinder chambers, rotary combustion engine of this invention with a stationary circular housing 1 containing a spark plug port 22 with a spark plug 34, a coolant intake 18, coolant outlet 17, an exhaust port 23 and an intake port 24. A front wall 14 is bolted at 27 to the housing 1 and has a round shaft 26 with a pin groove 35 protruding out the center of the front wall 14 and has an oil plug 30. The rear wall 15 is bolted at 27 to the housing 1 and has a shaft 26 protruding out the center of the rear wall 15. FIG. 16 is a two cycle, one or more cylinder chambers, rotary combustion engine with a stationary circular housing 1 which has a spark plug port 22 with a spark plug 34, a coolant intake 18 and a coolant outlet 17. A front wall 14 is bolted at 27 to the housing 1 and has a exhaust port 23, an intake port 24, an oil plug 30 and has a rotatable shaft 26 with a pin groove 35 extending through the center of the front wall 14. A rear wall 15 is bolted at 27 to the housing 1 which has a shaft 26 extending through the rear wall.

Figure 17:
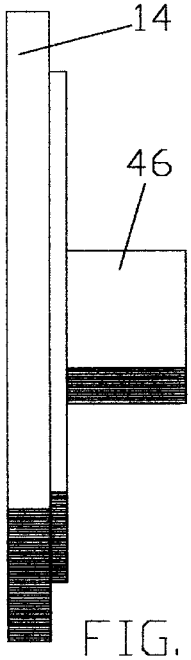
FIG. 17 is a side view of a four cycle engine head (front side wall) of a rotary engine.
Figure 18:
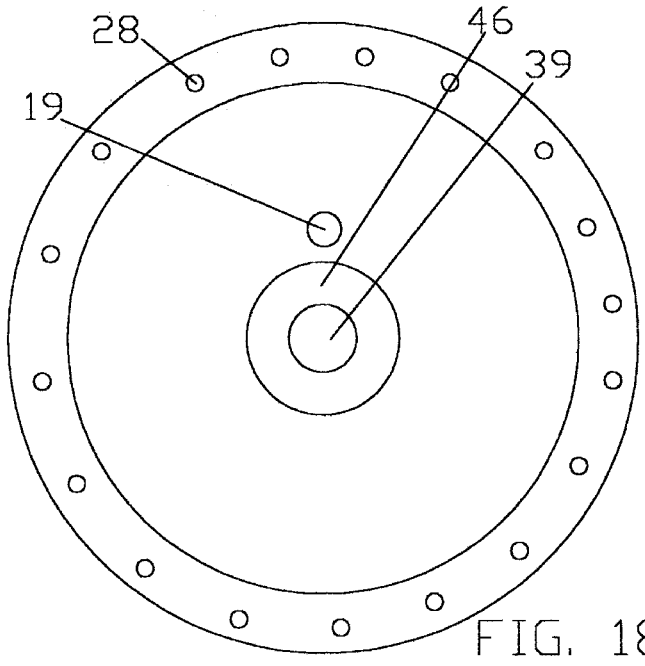
FIG. 18 is an inside view of a four cycle engine head of a rotary engine.
Figure 19:
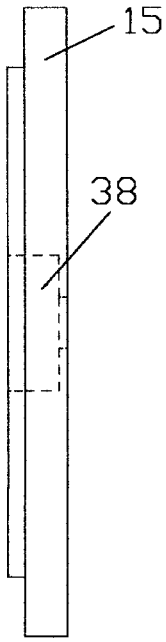
FIG. 19 is a side view of a rear wall of a four cycle rotary engine.
Figure 20:
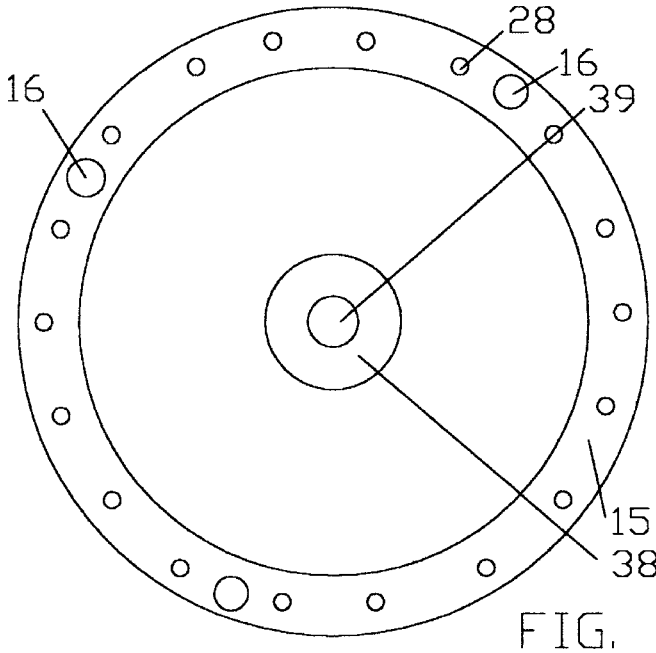
FIG. 20 is an inside view of a rear wall of a four cycle rotary engine.

FIG. 17, FIG. 18, FIG. 19 and FIG. 20 are views of the walls of the four cycle rotary combustion engines. FIG. 17 is a side view of the front wall (head) 14 which shows the front wall 14 which has a bearing holder 38 and a inward round projection 46 for the piston guide plate 12 to be bolted on. FIG. 18 is an inside view of the front wall 14 with its bolt holes 28, shaft exit 39 and piston guide plate holder 46. FIG. 19 is a side view of the rear wall 15 of a two or four cycle rotary engine and has a holder for a bearing 38 in the center of the wall. FIG. 20 is the inside view of the rear wall 15 of a two or four cycle rotary combustion engine with an opening 39 in the center of the wall for a shaft and a holder for a bearing 38 and a coolant passage way 16.

Figure 21:
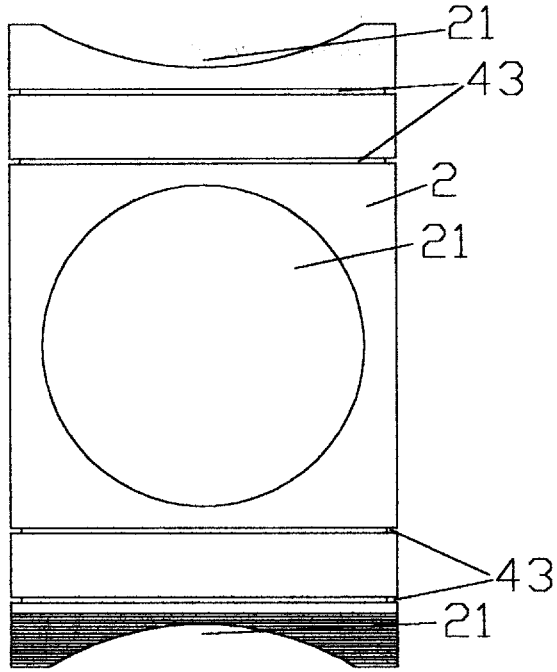
FIG. 21 is a side view of a rotor of a rotary engine with four cylinder chambers.
Figure 22:
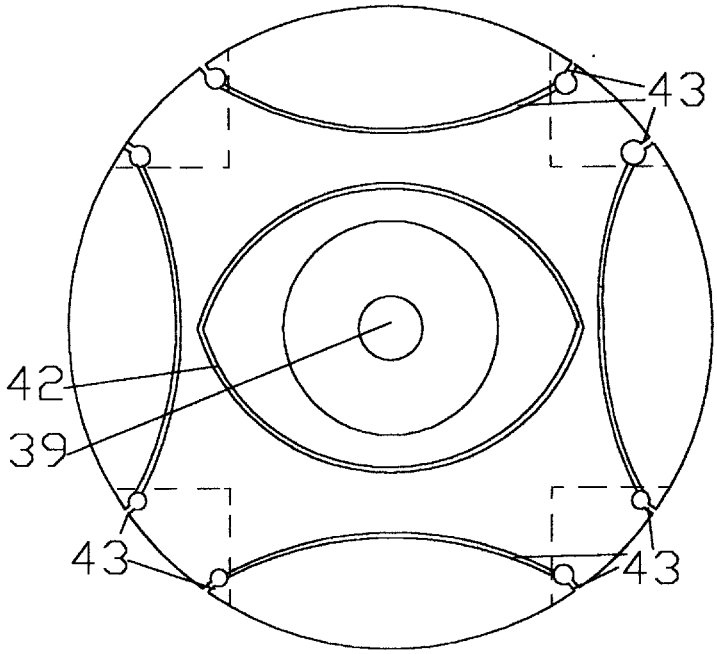
FIG. 22 is a front view of a rotor of a rotary engine with four cylinder chambers.

Referring to FIG. 21 and FIG. 22 are plan views of the rotor two or four cycle rotary combustion engine of this invention. FIG. 21 is a side view of a four cycle, four cylinder chamber 21 rotor 2 showing the seal grooves 43, oil seal grooves 42 and cylinder chambers 21. FIG. 22 is a front wall view of the four cylinder chambers rotor showing the seal grooves 43, oil seal grooves 42 and passage for the shaft 39 and opening into the central chamber 20.

Figure 25:
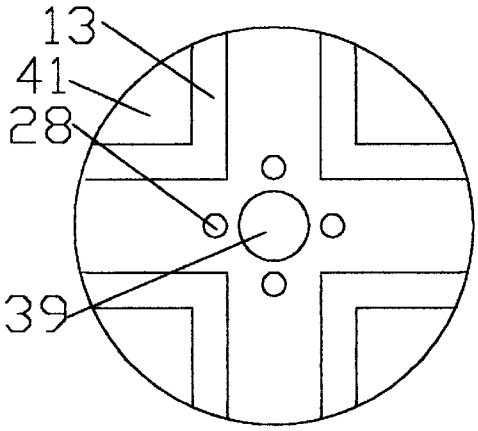
FIG. 25 is a front view of a piston rod guide plate of a rotary engine.
Figure 23:
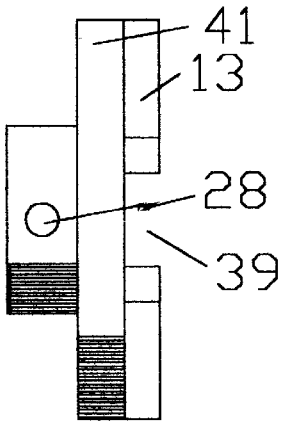
FIG. 23 is a side view of a piston rod guide plate of a rotary engine.
Figure 24:
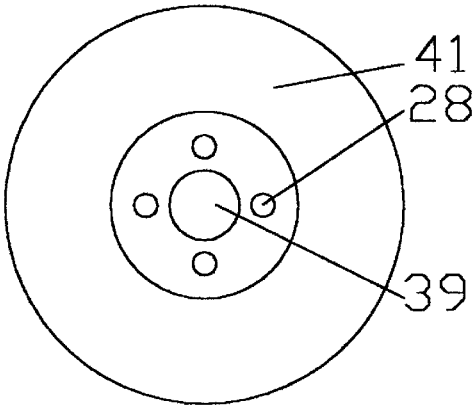
FIG. 24 is a rear view of a piston rod guide plate of a rotary engine.

Referring to FIG. 23, FIG. 24 and FIG. 25 which are views of the rotatable piston rod's guide plate 13, 41 which attach to the shaft 26 and posterior inner wall of the rotor 2 by means of bolts 27. FIG. 23 is a side view of the rod guide plate 41 with the rod guides 13 and showing the bolt hole 28 for bolting to the shaft 26. FIG. 24 is a rear view of the rod guide plate 41 with the bolt holes 28 and shaft passage 39. FIG. 25 is a front view of the rod guide plate 41 for a four cylinder chamber rotary engine showing the bolt holes 28 for attaching to the rotor 2, the passage for the shaft 39 and the rod guides 13.

Figure 28:
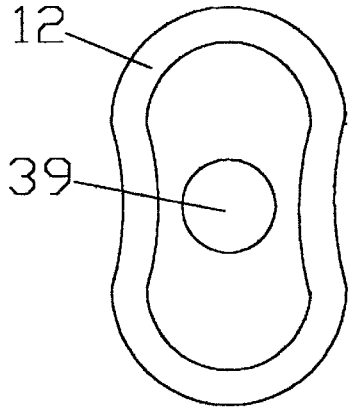
FIG. 28 is a rear view of a piston guide plate of a rotary engine.
Figure 26:
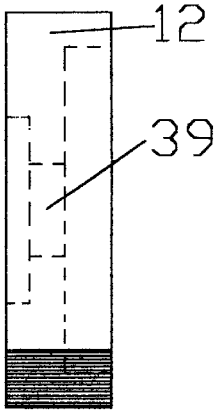
FIG. 26 is a side view of a piston guide plate of a rotary engine.
Figure 27:
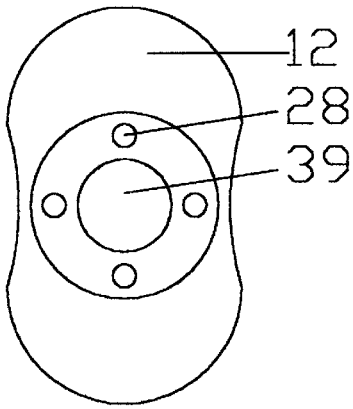
FIG. 27 is a front view of a piston guide plate of a rotary engine.

Referring to FIG. 26, FIG. 27 and FIG. 28 which are views of the stationary piston guide plate 12 for one or more cylinder chambers, rotary engine. FIG. 26 is a side view of the piston guide plate 12, FIG. 27 is a front view of the piston guide plate 12 showing the bolt holes 28 for bolting it to the front wall and passage for the shaft 26. FIG. 28 is a rear view of the piston guide 12 plate with a passage for the shaft 26.

Figure 30:
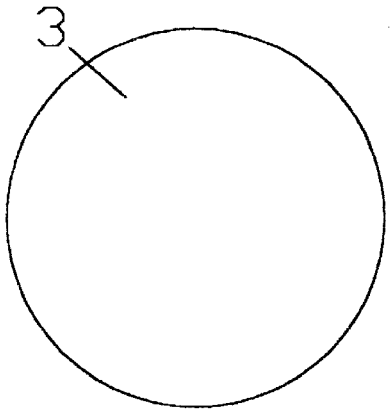
FIG. 30 is a top view of a piston of a rotary engine.
Figure 31:
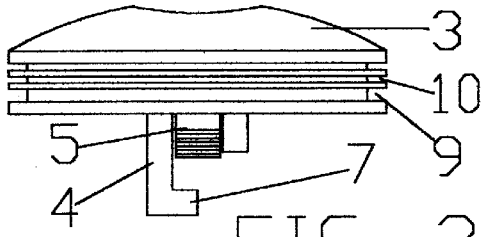
FIG. 31 is a side view of a piston for a four cycle rotary engine.
Figure 32:
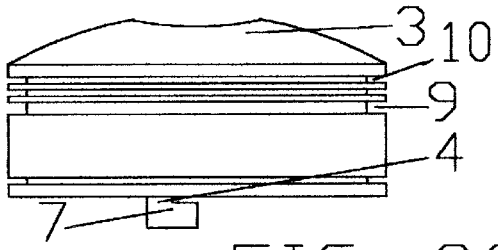
FIG. 32 is a side view of a piston of a two cycle rotary engine.
Figure 29:
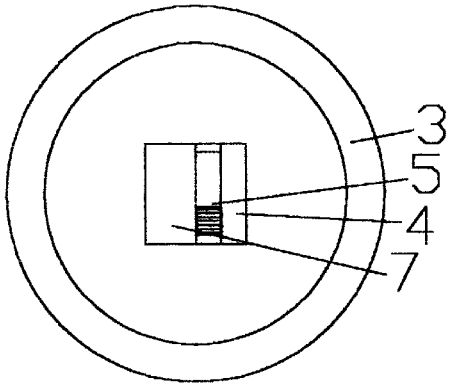
FIG. 29 is a bottom view of a piston of a rotary engine.
Figure 33:
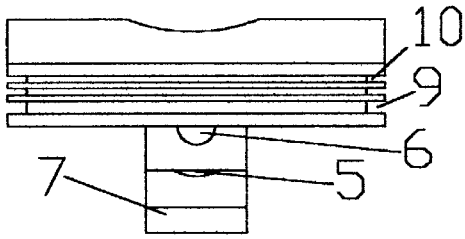
FIG. 33 is a rear view of a piston of a four cycle rotary engine.

Referring to FIG. 29, FIG. 30, FIG. 31, FIG. 32 and FIG. 33 are view of the pistons of two or four cycle, one or more cylinder chambers rotary engines. FIG. 29 is a bottom view of the piston 3 showing the rod 4, bearing 5 and rod inner guide pin 7. FIG. 30 is the top view of the piston 3. FIG. 31 is a side view of the piston 3 of a four cycle engine showing the ring 10 and oil ring grooves 9, rod 4, bearing 5 and rod inner guide pin 7. FIG. 32 is a side view of a two cycle piston which shows the ring grooves 10 and oil ring groove 9, piston rod 4 and rod's inner guide pin 7. FIG. 33 is a side view of the piston 3 showing a front view of the piston rod 4, rings grooves 10 and oil ring groove 9, pin 6 to hold bearing 5 in place and the rod's inner guide pin 7.

Figure 34:
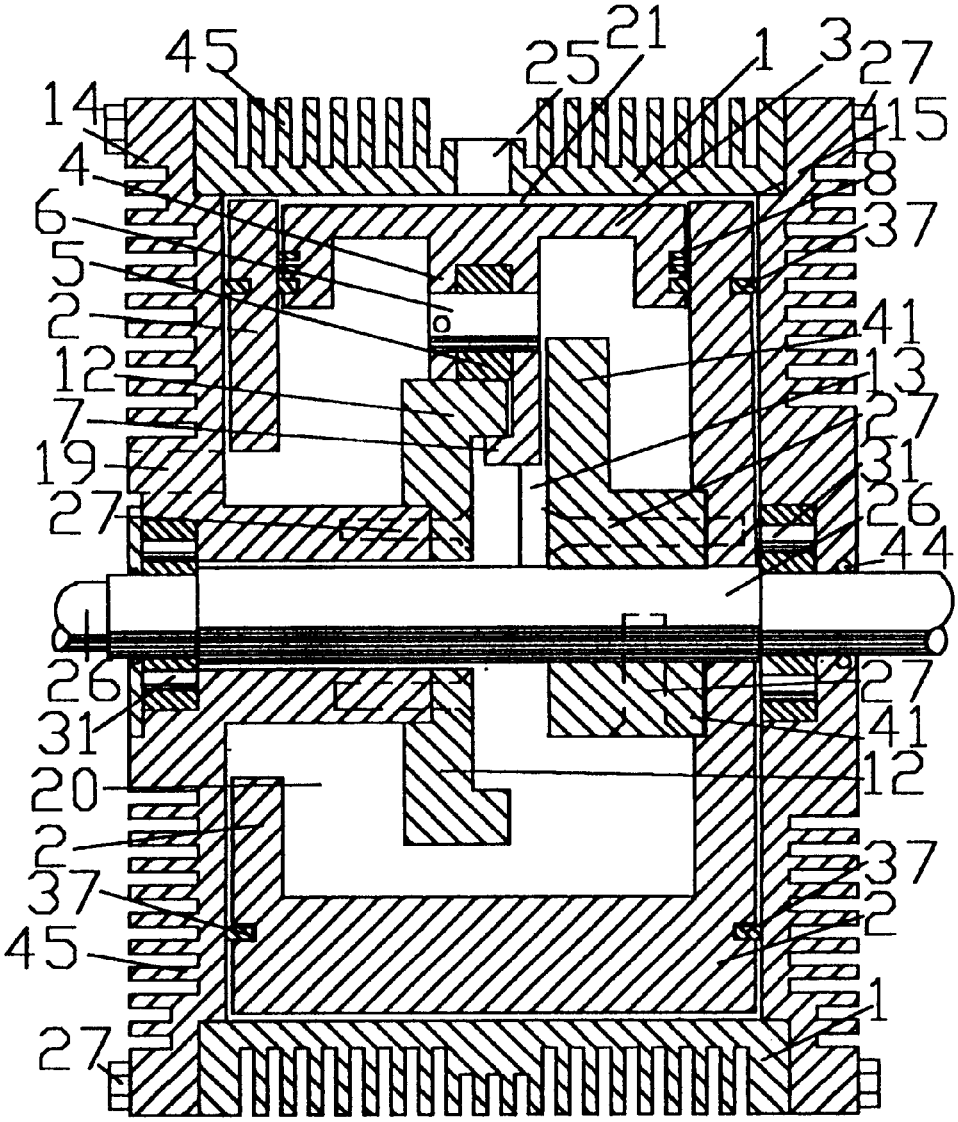
FIG. 34 is a sectional view of an air cooled, four cycle, one cylinder chamber, rotary engine.
Figure 35:
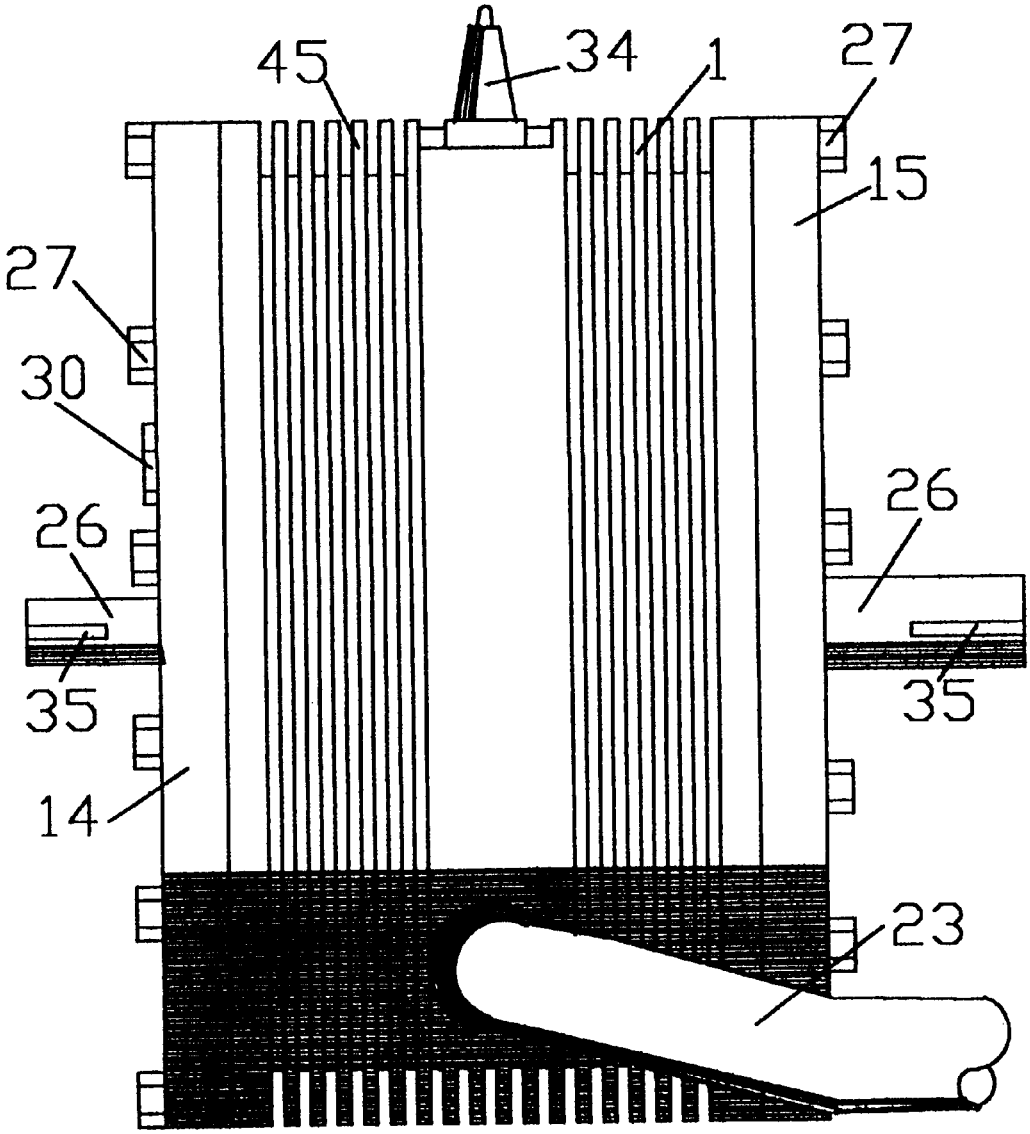
FIG. 35 is a plain view of an air cooled, four cycle, one cylinder chamber, rotary engine.

Referring to FIG. 34 and FIG. 35 are views of a four cycle, one cylinder or more chambers, rotary combustion engine with cooling fins on the housing and side walls, and is similar to FIG. 8 except for the cooling system. It has a fuel injection port 25. FIG. 34 is a sectional view showing the cooling fins on the housing, front side wall and rear side wall. FIG. 35 is a plan side view of the outside of a four cycle, one or more cylinder chamber rotary combustion engine showing the cooling fins 45 on the circular housing 1, the spark plug 34 and the exhaust system 23. The front wall 14 and the posterior wall 15 are bolted at 27 to the housing 1 and has a shaft 26 protruding out the center of the walls.

Figure 36:
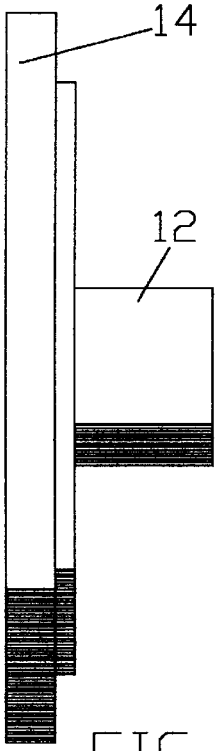
FIG. 36 is a side view of the front wall (head) of a two cycle rotary engine.
Figure 37:
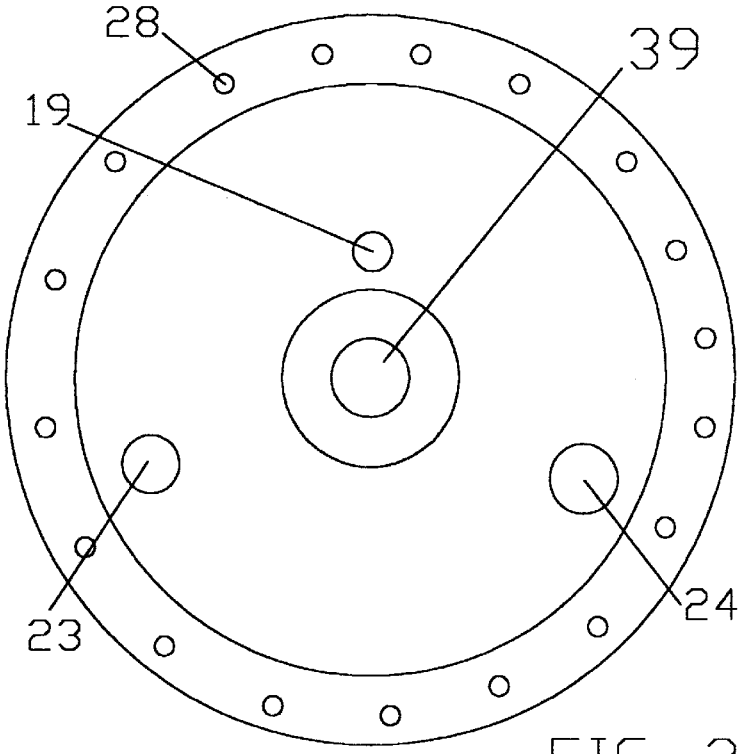
FIG. 37 is an inside view of the front wall (head) of a two cycle rotary engine.
Figure 39:
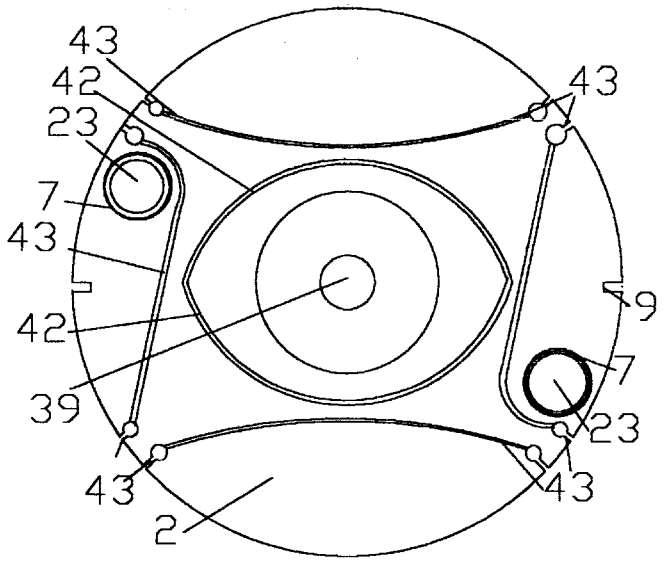
FIG. 39 is a front view of the rotor of a two cycle rotary engine.
Figure 38:
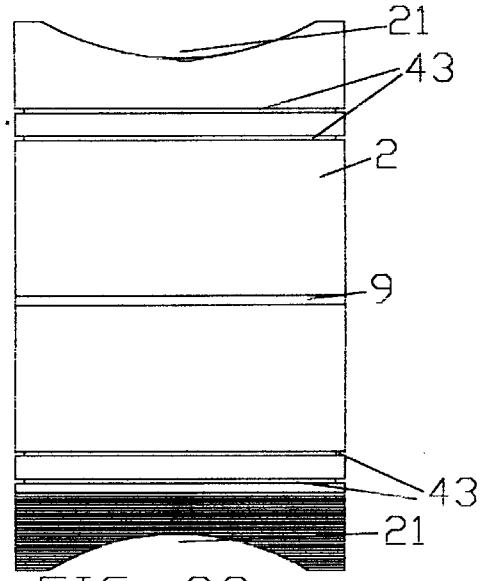
FIG. 38 is a side view of the rotor of a two cycle rotary engine.

Referring to FIG. 36 and FIG. 37 which are views of the anterior wall (head) of a two cycle rotary combustion engine. FIG. 36 is a side view of the front wall 14 which shows the inner central portion of the front wall 46, that the piston guide plate 12 is attached to. FIG. 37 is the inside view of the front wall 14 with the bolt 28 holes, oil inlet 19, exhaust port 23, intake port 24, shaft passage way 39 and the inner center portion of the wall 46 where the piston guide plate 12 is attached to. FIG. 38 is a plan view of the two cycle circular rotor 2 with two cylinder chambers 21, seal grooves 43 and oil seal groove 9. FIG. 39 is a front view of the two cycle circular rotor 2 showing the exhaust port 23 and intake port 24 with a ring 7 around each exhaust passages, seal grooves 43, oil seal grooves 42, oil seal 9, and an opening in the center of the rotor 2 for the shaft 26, and an opening to the central chamber 20.

Figure 40:
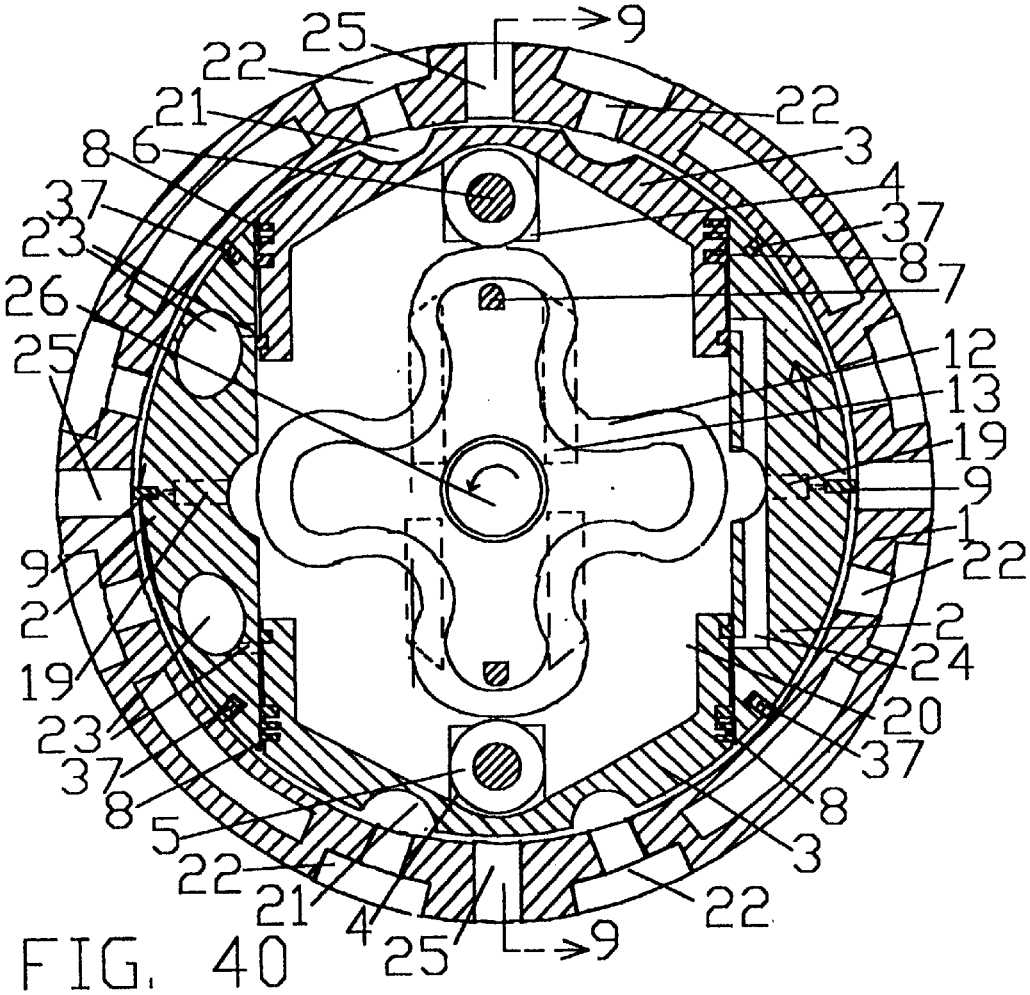
FIG. 40 is a cross section of a two cycle, two cylinder chambers, fuel injected, double spark plugs, rotary engine.

FIG. 40 is a cross section view of a two cycle, two cylinder chambers, rotary combustion engine. The stationary circular housing 1 has four fuel injection ports 25, eight spark plug ports 22, coolant passages and a circular inner wall. Inside the housing 1 is a circular rotatable rotor 2 with two cylinder chambers 21, two exhaust passages 23 and two intake passages 24, seals 37 and oil seals 9 on the peripheral area of the rotor 2 and a central oil and compression chamber 20. There is a piston 3 in each cylinder chamber 21 which has rings 8 and a piston rod 4 has a bearing 5 which is held in place by a pin 6 and has a inner guide pin 7. The rod's bearing travels on the clover leaf shaped stationary piston guide 12. The rod guide plate 13 guides the reciprocal motion of the rod 4. There is a shaft 26 in the center of the rotor 2 and is attached to the rotor.

Operation

The four cycle, one cylinder chamber, rotary combustion engine of FIGS. 1 and 2 operates with the rotor 2 rotating in the clockwise direction and starting from the position of the rotor 2 and piston 3 illustrated in FIG. 1 is in a position wherein the cylinder chamber is at its minimum volume, then the shaft 26 and rotor 2 with it's piston 3 are rotated clockwise 180 degrees through the expansion stroke and exhaust stroke then the piston is pulled toward the central chamber 20 by the rod inner guide pin 7 under the piston guide plate 12 as it rotates and vacuums in air from the intake port (intake stroke). The reciprocal motion of the rod 4 is guided by the rod guide plate 13 which keeps the piston straight in the cylinder chamber and by the shape of the piston guide plate 12. The cylinder chamber is then rotated passed the intake port 24 and the air in the cylinder chamber 21 is compressed (compression stroke) by the rod bearing 5 rotating on the piston guide plate 12 and pushes on the piston. Then just before the piston 3 makes a full rotation fuel is injected into the cylinder chamber 21 and mixes with the compressed air. After the maximum compression stroke of the piston 3, and the rotor 2 has made a full rotation, 360 degrees, the fuel-air mixture is fully compressed at its minimum volume, then the spark plugs are fired thereby igniting the fuel. The piston 3 is pressed by the combustion gases which produces pressure through the rod 4 onto the stationary piston guide plate 12 and this produces a clockwise rotary motion of the rotor 2 and rod bearing 5 on the piston guide plate 12 which allows the piston to reciprocate toward the central chamber and expand the cylinder chamber space to its maximum volume. The rotor 2 and shaft 26 are rotated 90 degrees and the piston reaches the exhaust port 23. As the rotor 2 rotates another 90 degrees and the exhaust gases are pushed out by the motion of the piston 3 being pushed toward the housing 1 (exhaust stroke) this reciprocal motion of the piston is guided by the piston guide plate 12, and the cylinder chamber volume is at its minimum as it passes the exhaust port 23 and reaches the intake port 24. The piston 3 is further rotated to the intake port and air is vacuumed into the cylinder chamber by the reciprocal motion of the piston 3 toward the center chamber (suction stroke) which is guided by the piston guide plate 12 and the rod inner guide pin 7. After the rotor 2 rotates another 90 degrees the piston 3 passes the intake port and the compression stroke guided by the piston guide plate 12, and the air is compressed, but before the minimum volume of the cylinder chamber is reached fuel is injected by the injection system 25 into the cylinder chamber 21. After the rotor 2 has rotated 360 degrees and the cylinder chamber is at its minimum volume the spark plugs 34 fires and a new rotation begins. The engine parts are oiled by oil in central chamber 20 which communicates with the oil rings 9 on the piston 3 and rotor 2. The engine is cooled by means of the circulating coolant in the coolant passage ways and an oil cooler. The shaft 26 is connected to the rotor 2 and rotates with the rotor 2.

The rotary engine of FIG. 2 operates as the rotary engine of FIG. 1 except that a fuel-air mixture is vacuumed in from the intake port by the suction stroke, then compressed on the compression stroke, and after a full rotation the compressed air-fuel mixture is ignited by two spark plugs 34. The ignited fuel-gas mixture presses against the piston 3 and the piston rod's bearing presses against the piston guide plate and produces a clockwise rotary motion of the rotor 2. The piston 3 different strokes are guided by the stationary piston guide plate 12 which is designed to give short timed exhaust and compression strokes and a long timed expansion stroke and suction stroke. The reciprocal motions of the piston rod 4 is guided by the rotating rod guide plate 13 and stationary piston guide plate 12. The expanding ignited gases are sealed in the combustion cylinder chamber by means of rings 8 on the pistons 3 and seals 37 on the rotor 2.

The four cycle rotary engine with two cylinder chambers of FIG. 3 operates similar to the engine of FIG. 1 except the it has two pistons 3 and one piston fires every 180 degrees of rotation. With the pistons 3 in the position wherein the cylinder chambers are at their minimum volume, and first piston 3 is at 0 degrees and the second piston is at 180 degrees, as shown in FIG. 3, then as the shaft 26 and rotor 3 are rotated clockwise the first piston 3 volume expands for 90 degrees and then exhausts for 90 degrees, and at the same time the second piston goes through the stroke of suction, wherein air is drawn into the cylinder chamber 20. Then as it rotates 90 degrees the air is compressed. Then just before it is fully compressed fuel is injected into the cylinder chamber 21 by the fuel injection system 25. When the air-fuel mixture is fully compressed by the second piston 3 and the second cylinder chamber volume is at it minimum, at 0 degrees, it is ignited by two spark plugs 34. The combustion gas presses this second piston 3 which presses the piston rod's bearing 5 against the piston guide plate 12 thereby forcing the piston and rotor 2 to rotate clockwise and allows the cylinder chamber 21 to expand. The shape of the stationary piston guide plate 12 and the rotating rod guide plate 13 guides the reciprocal motion of the pistons 3 and the rotary motion of the rotor 2. As the second piston rotates 90 degrees, full expansion of the combustion gases is completed, and the piston rotates to the exhaust port 23, then the exhaust gases are forced out by the second piston 3. While the second piston 3 goes through the expansion and exhaust stroke the first piston 3 goes through the suction and compression stroke, and fuel is injected from the injection system during this stroke. Then it is fired and a new cycle is started. The central chamber 20 contains oil which communicates with the piston rings 8 and rotor oil seals 37 which lubricates the piston 3 and rotor 2. The engine is cooled by coolant circulating through the coolant passages 16 in the housing 1 and by an oil cooler to cool the oil.

The four cycle, rotary combustion engines with multiple cylinder chambers of FIGS. 4, 5, and 6 operates the same way as FIG. 1 except that the gas-air mixture is vacuumed in from the intake port and there is only one spark plug 34. The rotary engine of FIG. 4 has three firings per each rotation of the rotor 2 and each cylinder chamber is fired once. FIG. 4 has three pistons which are in different strokes, one is in expansion stroke, second is at the end of exhaust stroke and the third is in compression stroke. The reciprocal motion of the pistons are guided by the shape of the stationary piston guide plate 12 and the rotating rod guide plate 13. The rotary engine of FIG. 5 had four cylinder chambers 21 placed 90 degrees apart in the rotor 2 and has 4 firings per 360 degree of rotation by one spark plug 34 at 0 degrees. In FIG. 5 the first piston, which is at 0 degree, is at the end of the compression stroke, the second piston, at 90 degrees, is at the end of expansion stoke, the third piston 3, at 180 degrees, is at the end of exhaust stroke and the fourth piston 3, at 270 degrees, is at the end of suction stroke and has vacuumed in a gas-air mixture. Each of the pistons 3 reciprocal motions are guided by the shape of the stationary piston guide plate 12 and rotary rod guide plate 12. The four cycle, 6 chambers, rotary combustion engine of FIG. 6 has six firings per 360 degree of rotation using one spark plug 34 at 0 degree. In FIG. 6 the first piston 3 is at the end of compression stroke, the second piston 3 at 60 degrees is in expansion stroke, the third piston at 120 degrees is in the beginning of exhaust stroke, the fourth piston at 180 degrees is at the of exhaust stroke, the fifth piston 3 is in the suction stroke and the sixth piston 3 is in early compression stroke. The pistons 3 reciprocal motions are guided by the shape of the stationary piston guide plate 12 and the rotatable rod guide plate 12 which keeps the pistons 3 straight in the cylinder chamber 21 and assist in forcing the rotor 2 to rotate. These engines are cooled by a circulating coolant in the housing's coolant passages 16 and by cooling the oil in the central chamber 20. The oil in the central chamber communicates with the oil rings 9 on the pistons and oil seals 9 on the rotor 3. The rotor 3 is attached to the shaft 26 and rotates with it.

The two cycle, rotary engines of FIGS. 10, 11 and 12 operate with the shaft 26 and rotor 2 rotating clock wise and the air and/or fuel-air with oil is vacummed in from the intake port 24 with a one way valve in the front housing wall into the central compression chamber 20 by the reciprocation of the piston or pistons 3 toward the housing 1 (compression stroke), then compresses the air plus fuel-air or fuel-oil-air mixture in the cylinder chamber 21. The compressed fuel-oil-air mixture is ignited by the spark plug 34 and the combustion gas pressures the piston 3 to reciprocate toward the central chamber 20 (expansion stroke). The air and/or fuel-air mixture in the central chamber is compressed by the compression stroke and at the end of the expansion stroke the compressed air and/or fuel-oil-air mixture passes through the intake passage 24 in the rotor 2 into the cylinder chamber. Then also when the piston 3 is at the end of the expansion stroke and the cylinder chamber is at its maximum volume the exhaust combustion gases pass out the exhaust passages 23 in the rotor 3, then out the exhaust port 23 in the front wall 14. The piston reciprocates toward the housing 1 thereby decreasing the cylinder chamber's volume size and compressing the air and/or fuel-air mixture. When a fuel injection system is used the fuel is injected into the cylinder chamber with the compressed air just before the end of the compression stroke and at the end of compression stroke all of the cylinder chambers are ignited at the same time. At the same time the compression stroke is compressing the gases, the gases are being vacuumed through the intake port 24 which has a one way valve into the central chamber 20. The cylinder combustion chamber 21 is sealed from the rest of the engine by means of rings 7 on the pistons 3, ring 7 around the exhaust passage to seal against the front wall and seals 37 on the rotor 2, which seals against the housing 1 and housing walls 14, 15. The reciprocal motions of the piston 3 is guided by the shape of the stationary piston guide plate 12 and the rotatable rod guide plate 13. The shaft 26 is attached to the rotor 3 and rotates with it. The two cycle, rotary engines are lubricated by means of a fuel-oil mixture or by oil in the central chamber 20 which communicates with the oil rings 9 and oil seals 9. These engines are cooled by a circulating coolant in the coolant passages 16 and/or cooling fins and an oil cooler. The two cycle, one cylinder chamber combustion engine of FIG. 10 with the piston in a position wherein the cylinder chamber volume is at it minimum the engine operates by rotating the shaft 26 and rotor 2 in a clockwise direction. The piston 3 is pulled toward the central chamber by means of the rod inner guide pin 7 which rotates under the stationary piston guide plate 12 and the reciprocal motions are guided by the shape of the stationary piston guide plate 12 and the rotatable rod guide plate 13. The air in the central chamber 20 is compressed then when the piston 3 is reciprocated toward the central chamber to where the cylinder chamber 21 is at its maximum volume the intake passage 24 and exhaust passage 23 in the rotor 2 are opened to the cylinder chamber 21. The compressed air in the central chamber 20 is passed into the cylinder chamber 21, and when combustion gases are present it passes out the exhaust passage 23. The piston 3 is then reciprocated toward the housing 1 thereby decreasing the volume in the cylinder chamber and compressing the gas. Just before the gas is completely compressed fuel is injected into the cylinder chamber 21 by the fuel injection system 25. When the fuel-air mixture is completely compressed and the cylinder volume is at it minimum the fuel-air mixture is ignited by a spark plugs 36. The combustion gases press against the piston 3 and the piston rod's bearing 5 presses against the stationary piston guide plate 12 and rod guide plate 13 thereby rotating the rotor 2 and expanding the cylinder chamber volume by reciprocating the piston toward the central chamber 20 (expansion stroke). At the same time the piston 3 is in the expansion stroke, the air in the central chamber 20 is being compressed, and the compressed air passes through the rotor's intake passage 24 into the cylinder chamber 21. The exhaust gases pass out the rotor's exhaust passage 23 at the end of the expansion stroke, then out through the exhaust port 23. There is one firing per 360 degree of rotation of the rotor 3. The expansion stroke and compression stroke takes place above the piston 3 and the suction stroke takes place when the compression stroke takes place and exhaust stroke takes place when the piston is down to where the cylinder chamber has its maximum volume. The engine is lubricated by means of oil in the central chamber and/or in the fuel. The engine is cooled by means of circulation coolant and an oil cooler.

The two cycle, one cylinder, rotary combustion engine of FIG. 11 fires twice, one time at 0 degree and one time at 180 degrees due to the design of the piston guide plate 12. This engine operates by rotating the shaft 26 and rotor 2 clockwise thereby pulling the piston toward the central chamber 20 by means of the rod inner guide pin 7, which rotates under the piston guide plate 12. The air is compressed in the central chamber 20. When the piston 3 reciprocates to where the cylinder chamber 21 is at its maximum volume (expansion stroke), the exhaust passages 24 and intake passages a 24 are opened to the cylinder chamber. The exhaust gases passes out the exhaust passage 23 when present, and the compressed air from the central chamber 20 passes into the cylinder chamber 21. Fuel is injected into the cylinder chamber 21 from the fuel injection system 25 as the piston 3 is guided toward the housing 1, thereby decreasing the volume of the cylinder chamber 21 and compressing the fuel-air or fuel-oil-air mixture to its minimum volume at 0 degrees. The compressed fuel-air mixture is ignited by two spark plugs 34. The combustion gases press against the piston, which presses the rod's bearing 5 against the stationary piston guide plate 12 and rotatable rod guide plate 13 thereby rotating the rotor 2 for 90 degrees as the piston 3 is reciprocating toward the central chamber 20. The cylinder chamber's maximum volume is reached thereby opening the exhaust passage 23 and the intake passage 24 to the cylinder chamber. The air in the central chamber is compressed as the piston chamber 21 is expanded, and passes through the intake passage 24 to the cylinder chamber 21. The exhaust gases pass out the piston's exhaust passage 23 then through the front wall's exhaust port 23 at the end of the expansion stroke. The air in the cylinder is compressed as the piston reciprocates toward the housing 1 and the fuel-oil mixture is injected into the cylinder chamber 21 by the fuel injection system 25. The fuel-oil-air mixture is compressed completely as the rotor 2 rotates to 180 degrees, then the two spark plugs 34 are fired. The combustion gases press on the piston 3, which pushes the rod's bearing 5 against the piston guide plate 12, thereby rotating the rotor 2 as the piston moves toward the central chamber (expansion stroke). The rotor 2 rotates for 90 degrees as the cylinder chamber 21 volume is expanded to its maximum thereby opening the exhaust passage 23 and intake 24 passages to the cylinder chamber 21. The exhaust flows out the rotor's exhaust passage 23, then to the exhaust port 23 in the front wall. The compressed air flows into the cylinder chamber 21 through the rotor's intake passage 24. The rotor 2 rotates another 90 degrees and during the rotation the fuel injection system 25 injects fuel-oil into the cylinder chamber and compresses the fuel-oil-air mixture. At the same time air is drawn into the central chamber 20 from the intake port 23 through a one way valve. The spark plugs 34 are fired and a new rotation is started.

The two cycle, three cylinder chamber rotary engine in FIG. 12 operates as FIG. 10 except that it has three pistons and each piston 3 fires three times per 360 degree rotation. All pistons are fired at the same time at 0, 120 and 240 degrees. The engine is started by rotating the shaft 26 and rotor 2 clockwise for 60 degrees then another 60 degrees thereby creating a suction in the central chamber 20 by the reciprocal motion of the pistons toward the housing 1 (compression stroke) and air is sucked in through the intake port 23 with a one way valve in the front wall into the central chamber 20. The rotor 2 is rotated another 60 degrees and the pistons 3 reciprocates toward the central chamber 20 (expansion stroke) and compress the air, and opens up the piston's intake passages 24 to the cylinder chambers 21. The rotor 2 rotates and the pistons 3 move toward the housing 1. Fuel-oil is injected by the injection system 25, then after rotating another 60 degrees the fuel-oil-air mixture is compressed in the cylinder chambers 21 to its minimum volume and at the same time draws in the air into the central chamber 20. The compressed fuel-oil-air mixture is ignited in the three cylinder chambers by the spark plugs 24 and the combustion gases press on the pistons 3 and the piston rod's bearing 5 thereby applies pressure on the stationary triangular shaped piston guide plate 12 and rod guide plate 13 thereby rotating the rotor 2. The rotor 2 is rotated 60 degrees as the piston is guided toward the central chamber 20 by the stationary piston guide plate 12 and rotatable rod guide plate 13, and expands the cylinder chambers 21 volume, then at the same time compresses the air in the central chamber 20. When the cylinder chambers are at maximum volume the rotor's exhaust passage 23 and intake passages 24 are opened to the cylinder chamber 21. The exhaust gases flow out the rotor's exhaust passages 23 to the exhaust port 23 in the front or back wall. The compressed air flows into the cylinder chambers 21 through the rotor's intake passages 24 and a new rotation cycle is started. A two cycle, two cylinder chamber rotary combustion engine would operate similar to the engine in FIG. 12, wherein the two cylinder chambers would be fired at the same time every 180 degrees of rotation.

Multiple two or four cycle rotary engines operate as the individual engine as illustrated above. The shaft 26 would rotate with and attached to all of the rotors 2 in the multiple rotary engines as in FIG. 13 and FIG. 14. The central chamber 20 of the four cycle engine may communicate with the other engines central chambers 20. In the two cycle rotary multiple engines the central chambers 20 sealed from each other unless all the pistons 3 spark plugs 34 fire at the same time. In multiple two cycle engine the exhaust gases are exhausted through the exhaust passages 23 in the rotor then through the exhaust port 23 in the front side wall or rear side wall. The multiple four cycle, rotary engines exhaust though the exhaust port 23 in the housing. The multiple engines may be arranged to be fired at the most desirable time or all the spark plugs 34 may be fired at the same time. The rotors of multiple rotary engines may have 1 or more pistons as workable. FIG. 13 is a four cycle, double rotary combustion engine with one or more cylinder chamber 21 in each engine. Each engine operates separately similar to the four cycle, rotary combustion engine of FIG. 1 except that they do not have an injection system 25. The fuel-air mixture is vacuumed into the cylinder chamber 21 through the intake port 24 on the suction stroke. Both rotors 2 are attached to a single shaft and the rotate together in a clockwise rotary motion. The two spark plugs 34 may be fired at the same time or fired at different times such as one may fire at 0 degree and the other one fire when the shaft 26 has rotated 180 degrees. The oil central chambers 20 communicate with each other and the rear walls of the engines are connected together.

It will be understood that various changes and modifications may be made in the constructions described which provide the characteristics of this invention without departing from the spirit thereof particularly as defined in the following claims.

What is claimed is:

1. An internal combustion engine of the rotary type with a piston or pistons comprising, a housing formed with a peripheral wall which contains a cylindrical inner wall attached to side walls at 90 degrees, a cylindrical rotor, rotationally mounted in said housing and having a circular peripheral wall, side walls at 90 degrees to said peripheral rotor wall, with one said rotor's side wall having means to be attached to an engine's shaft which protrudes through the center of said housing side walls and the other said side wall having a central opening, a central chamber in said rotor, and one or more circular cylinder chambers extending from the said rotor's peripheral wall to the central chamber of said rotor, said rotor having means to seal each of said cylinder chamber from any other cylinder chamber or chambers and said central chamber, a piston with a piston rod for each said cylinder chamber or chambers, reciprocally mounted and forming a variable volume in said cylinder chamber or chambers and having means to seal the cylinder chamber or chambers from the said central chamber of the said rotor, a piston rod guide attached to the inner wall of said rotor's side wall is the means to guide the reciprocal motions of said piston and a piston guide plate attached to said housing side wall providing means to rotate the said rotor, said housing being provided with means admitting a gaseous mixture communicating with said cylinder chamber or chambers, means discharging combustion products communicating with said cylinder chamber or chambers and ignition means communicating with said cylinder chamber or chambers, said shaft with means to guide the said rotor's rotary motion in said housing, each said cylinder chamber or chambers of varying size enabling a compression of a gaseous mixture to take place after suction, ignition of said compressed gaseous mixture and expansion of each cylinder chamber due to the pressure of said combustion products.

2. The engine according to claim 1, wherein the peripheral wall of said housing is provided with exhaust ports extending therethrough and is provided with intake ports extending therethrough, said ports being adapted to be opened or closed by said rotor during rotation.

3. The engine according to claim 1, wherein the side wall of said housing is provided with exhaust ports extending therethrough and is provided with intake ports extending therethrough, said ports being adapted to be opened or closed by said rotor during rotation.

4. The engine according to claim 1 wherein the engine is cooled by a liquid cooling system.

5. The engine according to claim 1 wherein the engine is cooled by air flowing over cooling fins.

6. The engine according to claim 1 wherein two or more the engines are attached together.

7. The engine according to claim 1 wherein the piston guide plate is designed to produce longer timed expansion and suction strokes with more rotation of the rotor and a shorter timed exhaust and compression strokes with less rotation of the rotor compared to the rotation of the rotor during the expansion and suction strokes.

8. A rotary combustion engine with piston in the rotor having a cycle which includes the four strokes of intake, compression, expansion and exhaustion, said engine comprising:

a) a housing formed with a peripheral wall with side walls, said peripheral inner wall being cylindrical, leaving space in the said housing for a rotor to rotate and being provided with means for admitting a gaseous mixture communicating with cylinder chambers in the said rotor, means for discharging combustion products communicating with said cylinder chambers;

b) a rotor with a circular peripheral wall with side walls, a central chamber, and cylinder chamber or chambers which are cylindrical and extend from the peripheral wall of said rotor to the rotor's said central chamber, one side wall of said rotor has means to attach to the engine shaft and the other side wall has a centrally located opening into said central chamber, the peripheral wall and side walls of said rotor have seals to seal against the housing's peripheral wall and side walls, to seal off the said cylinder chamber from other cylinder chambers and from the said central chamber, said rotor being rotationally mounted in said housing and attached to the engine shaft;

c) a piston with a piston rod, mounted in the said cylinder chamber or chambers, and having rings to seal the said cylinder chamber from the said central chamber;

d) a piston guide plate, mounted on the said housing side wall and having means to guide the reciprocal motions of the said piston, means for the said piston's rod to push on said piston guide plate to rotate said rotor and varying the volume of the cylinder chamber enabling a compression of a gaseous mixture to take place after aspirating a gaseous mixture;

e) a piston rod guide plate, mounted on the said rotor's inner side wall and having means to guide the said piston's rod's reciprocal motions;

f) an ignition system having means for igniting compressed gaseous mixture thereby causing expansion of said cylinder chambers due to pressure of said combustion products.

9. The engine according to claim 8 wherein the combustion fuel is injected directly into the cylinder chambers containing compressed air during the compression stroke by a direct injection system.

10. The engine according to claim 8 wherein the combustion fuel is injected directly into the cylinder chambers containing compressed air at the end of the compression stroke and before ignition by means of an air-assisted direct injection system.

11. The engine according to claim 8 wherein two or more of the engines are attached together.

12. A rotary combustion engine with piston having a cycle of two strokes, compression and expansion, wherein exhaust and intake takes place at the end of the expansion stroke; said engine comprising:

a) a housing formed with a peripheral wall with side walls, the inner surface of said peripheral inner wall being cylindrical with space for a cylindrical rotor to be rotationally mounted inside, said housing having means for admitting a gaseous mixture communicating with cylinder chamber or chambers of said rotor, and means for discharging combustion products communicating with cylinder chamber or chambers;

b) a rotor, formed with a peripheral cylindrical wall, side walls and a central chamber, said rotor having a cylinder chamber or chambers that open on the peripheral wall and central chamber of said rotor which has exhaust passages and intake passages which communicate with the cylinder chamber or chambers when the said piston is at the end of its expansion stroke, and said exhaust passages communicate with the exhaust port in said housing wall, one side of said rotor is attached to the engine's shaft and the other side wall is centrally open to the central chamber, said rotor has means to seal the said cylinder chambers from each other and from the said central chamber of said rotor which is rotationally mounted in the said housing on said shaft;

c) a piston with a piston rod, reciprocally mounted in said rotor's cylinder chamber or chambers with means to seal the said rotor's cylinder chamber from the central chamber;

d) a piston guide plate; mounted on a wall of said housing's side wall with means to guide the reciprocal motions of said piston and rotary motion of said rotor;

e) a piston rod guide plate; mounted on the inner wall of said rotor with means to guide the reciprocal motions of the said piston's rod;

f) a shaft; mounted in the center of the housing and attached to said rotor and passes through the housing's side walls and extends out passed the said housing side wall;

g) an ignition system; having means for igniting the compressed gaseous mixture thereby causing expansion of said cylinder chamber or chambers due to pressure of said combustion products.

13. The engine of claim 12 wherein the rotor has two or more cylinder chambers and pistons.

14. The engine according to claim 12 wherein the combustible fuel is injected directly into the cylinder chambers containing compressed air after the compression stroke and before the ignition by means of a direct injection system.

15. The engine according to claim 12 wherein the engine is cooled by a liquid coolant.

16. The engine according to claim 12 where the engine is cooled by air circulating over fins.

17. The engine according to claim 12 wherein two or more of the engines are attached together.

18. The engine according to claim 12 wherein the combustion fuel is injected directly into the cylinder chamber containing compressed air at the end of the compression stroke and before ignition by means of an air-assisted direct injection system.

* * * * *